US010822799B2

(12) United States Patent
Ryan

(10) Patent No.: US 10,822,799 B2
(45) Date of Patent: Nov. 3, 2020

(54) REBAR CAP

(71) Applicant: Daniel John Ryan, Auckland (NZ)

(72) Inventor: Daniel John Ryan, Auckland (NZ)

( * ) Notice: Subject to any disclaimer, the term of this patent is extended or adjusted under 35 U.S.C. 154(b) by 78 days.

(21) Appl. No.: 15/778,128

(22) PCT Filed: Nov. 21, 2016

(86) PCT No.: PCT/IB2016/057016

§ 371 (c)(1),
(2) Date: May 22, 2018

(87) PCT Pub. No.: WO2017/089948

PCT Pub. Date: Jun. 1, 2017

(65) Prior Publication Data

US 2018/0334807 A1 Nov. 22, 2018

(30) Foreign Application Priority Data

Nov. 23, 2015 (NZ) ..... 714343
Aug. 8, 2016 (NZ) ..... 723020

(51) Int. Cl.
*E04C 5/16* (2006.01)
*E04G 21/32* (2006.01)

(52) U.S. Cl.
CPC ..... *E04C 5/161* (2013.01); *E04G 21/32* (2013.01)

(58) Field of Classification Search
CPC ..... E04C 5/161; E04G 21/32; E04G 21/3252
USPC ..... 52/301
See application file for complete search history.

(56) References Cited

U.S. PATENT DOCUMENTS 4,202,378 A 5/1980 Bush et al.
5,313,757 A * 5/1994 Schnepf ..... E04C 5/161 138/96 R
5,363,618 A * 11/1994 Underwood ..... E04C 5/02 52/301
5,381,636 A * 1/1995 Kassardjian ..... B29C 45/14065 138/96 R
D363,657 S * 10/1995 Kassardjian ..... D8/354
5,729,941 A * 3/1998 Kassardjian ..... E04C 5/161 248/523
5,943,836 A * 8/1999 Kassardjian ..... E04G 21/32 248/523
5,992,434 A * 11/1999 Berlin ..... A45B 9/04 135/66

(Continued)

FOREIGN PATENT DOCUMENTS

ES 2506015 A1 10/2014
JP H11241512 A 9/1999

(Continued)

OTHER PUBLICATIONS

International Search Report and Written Opinion issued in counterpart International Application Serial No. PCT/IB2016/057016 dated Jan. 31, 2017.

*Primary Examiner* — Brian E Glessner
*Assistant Examiner* — James J Buckle, Jr.
(74) *Attorney, Agent, or Firm* — Mark H. Whittenberger; Holland & Knight LLP

(57) ABSTRACT

A removable cap for the exposed end of a reinforcing bar, including: a body including: at least one wall and an end, the at least one wall and the end defining a cavity having an opening; and at least one flap pivotably attached to the at least one wall at or near the opening.

18 Claims, 22 Drawing Sheets

(56) References Cited

U.S. PATENT DOCUMENTS

| | | | | | |
|---|---|---|---|---|---|
| 6,085,478 | A | | 7/2000 | Workman | |
| D494,451 | S | * | 8/2004 | Winig | D8/356 |
| D499,005 | S | * | 11/2004 | Winig | D8/356 |
| 7,716,898 | B1 | * | 5/2010 | Dunn | E04G 21/32 248/49 |
| D737,120 | S | * | 8/2015 | Recker | D8/354 |
| 9,309,673 | B1 | * | 4/2016 | Tscharner | E04G 21/3252 |
| 2002/0116887 | A1 | * | 8/2002 | Niday | E04C 5/161 52/318 |
| 2008/0168726 | A1 | * | 7/2008 | Yang | E04C 5/161 52/301 |
| 2009/0107067 | A1 | * | 4/2009 | Beery | E04C 5/161 52/301 |
| 2009/0313927 | A1 | * | 12/2009 | Myers, Jr. | E04C 5/161 52/301 |
| 2012/0291381 | A1 | * | 11/2012 | Kassarjian | E04G 21/3252 52/301 |
| 2013/0019537 | A1 | * | 1/2013 | Falcone | E01F 13/028 49/463 |
| 2014/0017426 | A1 | * | 1/2014 | Kassarjian | E04G 21/3252 428/35.6 |
| 2017/0314270 | A1 | * | 11/2017 | Zorio, III | E04C 5/161 |
| 2018/0298613 | A1 | * | 10/2018 | Eversberg | E04C 5/161 |

FOREIGN PATENT DOCUMENTS

| | | | |
|---|---|---|---|
| JP | 2001027046 | A | 1/2001 |
| WO | 2015109288 | A2 | 7/2015 |

* cited by examiner

REBAR CAP

CROSS-REFERENCE TO RELATED APPLICATIONS

This application is a U.S. National Stage of International Patent Application No. PCT/IB2016/057016, filed Nov. 21, 2016, which claims priority to New Zealand Patent Application No. 714343, filed on Nov. 23, 2015 and claims priority to New Zealand Patent Application No. 723020, filed on Aug. 8, 2016. The disclosure of each application is incorporated herein by reference in their entirety.

TECHNICAL FIELD

The present invention provides improvements and modifications to a removable cap for the exposed end of a reinforcing bar on a construction site.

BACKGROUND

During construction using concrete, reinforcing bars ("rebars") are used to improve the strength of the concrete. The ends of these bars often protrude from the concrete during the construction process. There is a significant risk of injury (or even death) resulting from impalement if a person falls on to the end of a rebar.

To avoid this, a number of safety caps have been designed.

U.S. Pat. No. 4,202,378 describes a rebar safety cap featuring a number of internal longitudinal, inwardly extending ribs to grip the end of the rebar. The rebar end is frictionally engaged with these fixed ribs, as well as fixed internal projections near the top of the cap.

U.S. Pat. No. 5,729,941 describes an alternative protective cover for concrete reinforcing bar, which is includes inwardly extending and off-centre fixed fins which flex outwardly so as to accommodate and secure reinforcing bars of varying sizes.

U.S. Pat. No. 6,085,478 describes an impalement prevention safety system including embodiments in which fixed internal fins, which are disposed generally transverse to an axis of the cover, abut the end of the rebar to maintain the system in an operative position on the end of the rebar.

In practice, these caps may be easily dislodged when they are bumped. Furthermore, the fixed engagement fins can become worn or deformed by being pressed on to or pulled off the end of a rebar, reducing the effectiveness of their friction fit over multiple uses.

WO 2015/109288 A2 describes a complex system designed to provide for better engagement of a protective rebar cover with the end of a rebar. This system includes a plurality of levels of horizontal fins adapted for gripping and holding the protective rebar cover firmly on spiralled surface ribs on the end of a rebar.

DISCLOSURE OF INVENTION

It would be advantageous if a safety cap could be provided for the exposed end of a rebar, which provides at least one advantage over the existing art, for example by being less likely to be easily dislodged from the end of the rebar by being knocked, capable of being used with multiple sizes or styles of rebar, or at least to provide a useful choice.

Therefore in a first aspect the present invention provides a cap for a rebar, including:

a body including at least one wall and an end, the at least one wall and the end defining a cavity having an opening; and at least one flap pivotably attached to the at least one wall at or near the opening.

Preferably the cap further includes at least one fin inside the cavity protruding from the at least one wall, extending at least part of the length of the cavity from at or near the end towards the opening, the amount the or each fin protrudes reducing towards the opening.

In a preferred embodiment, there are three walls. In a highly preferred embodiment, the three walls are of equal dimension. Alternatively, there may be four, five or more walls.

Preferably, there are three fins, one fin extending from each wall. More preferably, there are six fins. In a preferred embodiment, each fin is contiguous with the end of the body. Preferably the or each fin reduces in size in a series of steps.

In a preferred embodiment, there are three flaps, one attached to each of three walls. Preferably each flap is approximately triangular in shape, extending away from the wall to a tip. In an alternative preferred embodiment, each flap includes a tip and an engagement edge. Preferably three flaps can overlap to hold each other across the opening.

Preferably the or each flap includes means for enhancing its engagement with the rebar. In a preferred embodiment, the engagement enhancement means are a series of spines extending from a surface of the or each flap.

In a preferred embodiment, the cap is fabricated from a plastics material, preferably a UV resistant plastic. More preferably still, the cap is integrally formed. In an alternative embodiment, the cap is fabricated from metal.

Optionally the end is adapted to withstand an impact. Preferably the end includes a section fabricated from a thicker material, or an insert such as a metal disc. In a preferred embodiment, the cap may include an end plate larger than the circumference of the wall. More preferably, the end plate may include reinforcing means, optionally struts or at least one thicker section.

In another aspect, the present invention provides a cap for a rebar including:

a casing having at least one casing wall and an end, the at least one wall and the end defining a cavity having an opening;

at least two inserts dimensioned to fit inside the cavity, one closer to the opening than the other, and each having at least one insert wall defining an insert bore;

each insert including at least one flap pivotably attached to the or each insert wall and extending at least partially across the insert bore.

Preferably each insert is identical. In a preferred embodiment, each insert has three insert walls. In a highly preferred embodiment, the three insert walls are of equal dimension.

In a preferred embodiment, each insert has three flaps, one attached to each of three insert walls. Preferably each flap is approximately triangular in shape, extending away from the insert wall to a tip.

In a preferred embodiment, the inserts are fabricated from a plastics material, preferably a UV resistant plastic. In an alternative embodiment, the inserts are fabricated from metal.

In a preferred embodiment, the casing is fabricated from a plastics material, preferably a UV resistant plastic. In an alternative embodiment, the casing is fabricated from metal.

Optionally the end may include at least one section adapted to withstand an impact. Preferably the section may be fabricated from a thicker material, or an insert such as a metal disc. In a preferred embodiment, the casing may include an end plate larger than the circumference of the wall.

BRIEF DESCRIPTION OF THE DRAWINGS

By way of non-limiting example only, preferred embodiments of the invention are described in detail below with reference to the accompanying drawings, in which.

BEST METHODS OF PERFORMING THE INVENTION

First Preferred Embodiment

A first preferred embodiment of a cap 101 according to the present invention is described below in detail with reference to FIGS. 1 to 7.

Figure 2:
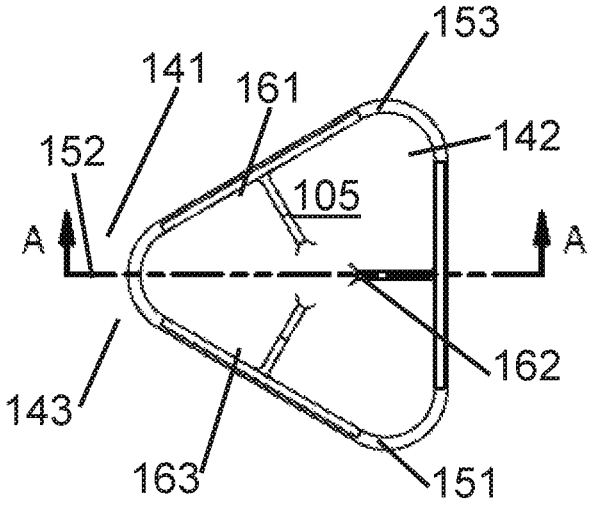
FIG. 2 is a bottom view of the rebar cap of FIG. 1.

Cap 101 includes a body 102 including an end 103 and at least one wall 104. The at least one wall 104 forms an elongated hollow prism (which may be about 70 mm long), closed at one end by end 103 to form a cavity 105 with an opening 106 at the distal end of the body 102 from end 103. In this first preferred embodiment, there are three walls:—first wall 141, second wall 142 and third wall 143. The three walls are of equal width (preferably about 60 mm), and integrally formed, with the first wall 141 connecting to second wall 142 at a third vertex 153, second wall 142 connecting to third wall 143 at a first vertex 151, and third wall 143 connecting to first wall 141 at a second vertex 152. Preferably the three vertices are rounded, as shown in FIG. 2. The rounded triangular structure of body 102 is preferred because it can be easily manufactured to provide the necessary strength to withstand the impact of someone falling on it, with minimal structural weak points.

Body 102 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

The end 103 may optionally include at least one reinforced section (not shown) to increase its strength. This may be achieved by increasing or varying the thickness of the end 103, or by including a section made from a different material (such as a metal disc). The exact characteristics of the end 103 may be varied, as will be apparent to one skilled in the art, to comply with regulatory requirements in different jurisdictions. For example, compliance with the U.S. and European standard for withstanding a load of 250 pounds (~113 kg) dropped from 10 feet (~3 m) may be achieved by including a metal disc, as is known in the prior art.

In the cavity 105, near end 103, is at least one fin. In this first preferred embodiment, there are three fins. First fin 161 extends from the centre of first wall 141 towards first vertex 151, stopping at or before the central axis of body 102, and is contiguous with end 103. First fin 161 tapers towards opening 106, so that it does not protrude so far into cavity 105 away from end 103. First fin 161 does not extend the entire length of the body 102. Second fin 162 extends from the centre of second wall 142 towards second vertex 152, stopping at or before the central axis of body 102, and is contiguous with end 103. Second fin 162 tapers towards opening 106 (as most clearly shown in FIGS. 3 and 6), so that it does not protrude so far into cavity 105 away from end 103. Second fin 162 does not extend the entire length of the body 102. Third fin 163 extends from the centre of third wall 143 towards third vertex 153, stopping at or before the central axis of body 102, and is contiguous with end 103. Third fin 163 tapers towards opening 106, so that it does not protrude so far into cavity 105 away from end 103. Third fin 163 does not extend the entire length of the body 102.

The three fins are preferably integrally formed with the body 102. The advantage of the three fins being contiguous with end 103 is that they thus provide additional structural support to end 103, improving its effective strength when it receives an impact.

Figure 1:
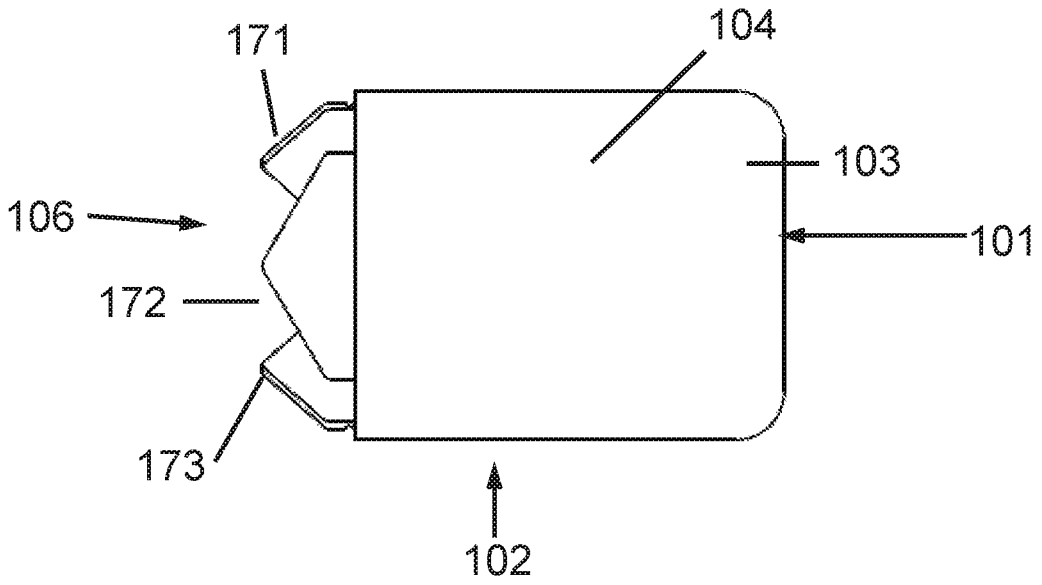
FIG. 1 is a side view of a rebar cap according to a first preferred embodiment of the present invention, before installation.
Figure 3:
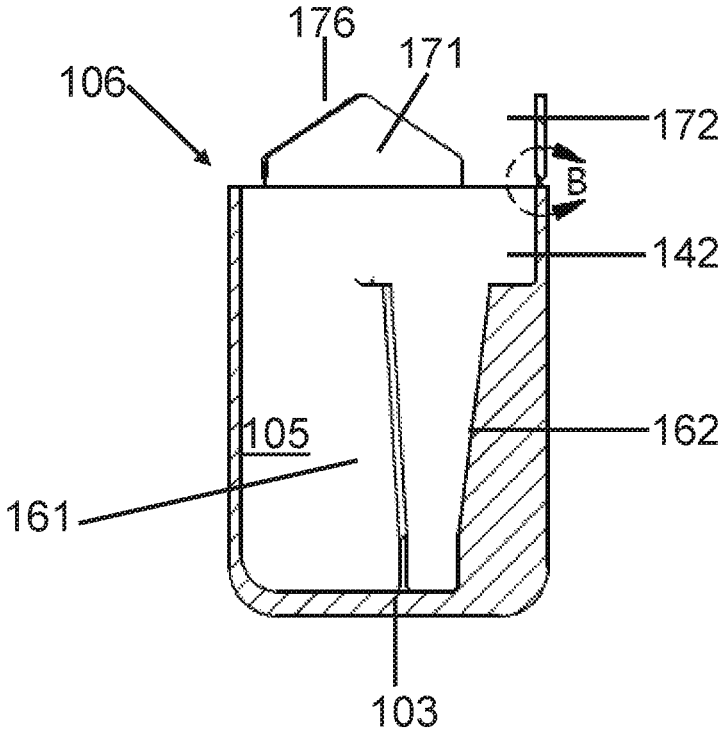
FIG. 3 is a cross section of the rebar cap of FIG. 2 along the section line A-A.
Figure 5:
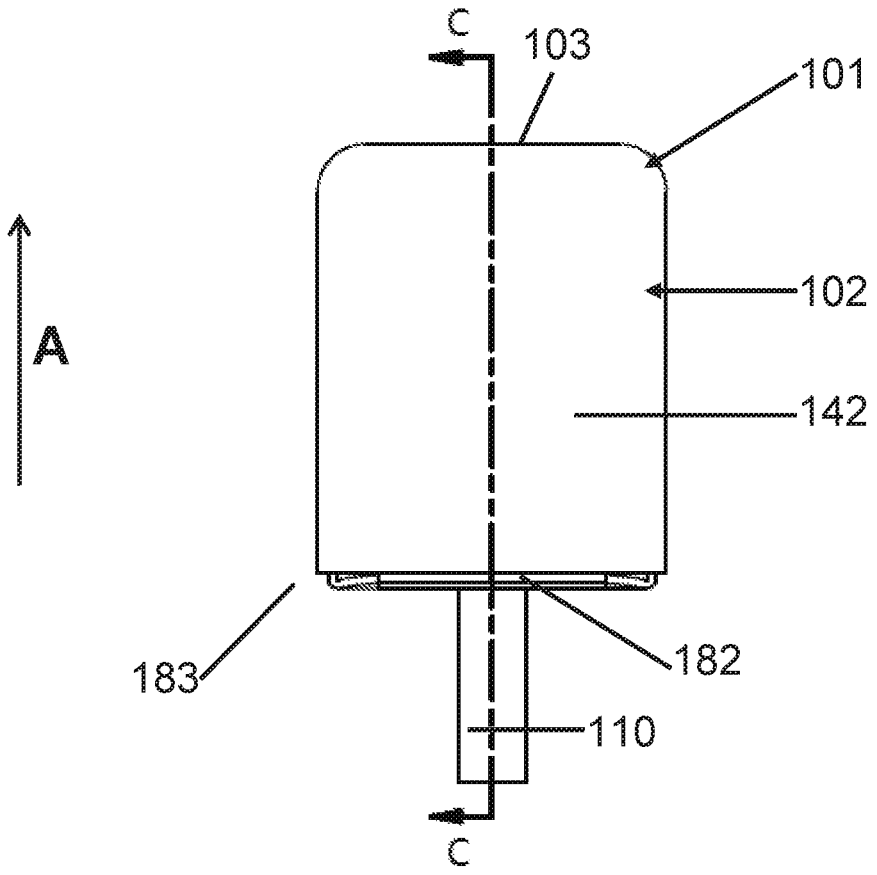
FIG. 5 is a side view of the rebar cap of FIG. 1 in use.
Figure 6:
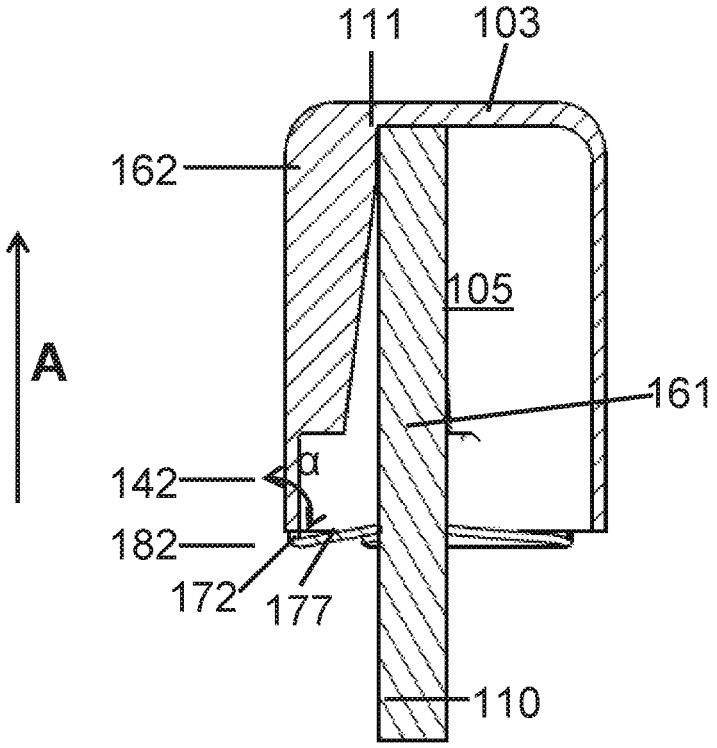
FIG. 6 is a cross section of the rebar cap of FIG. 5 along the section line C-C.
Figure 7:
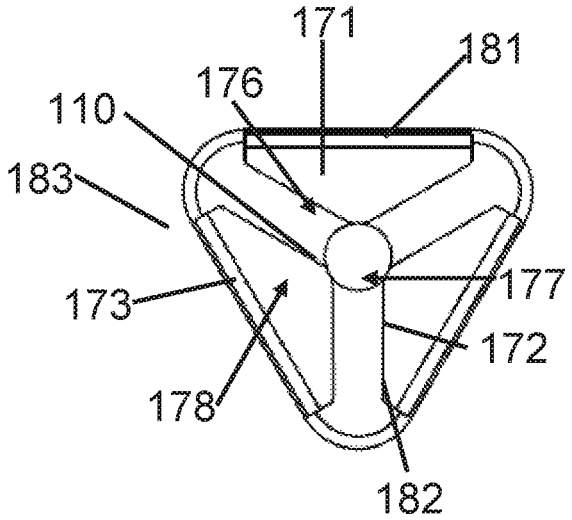
FIG. 7 is a bottom view of the rebar cap of FIG. 5.

Near the opening 106, the wall 104 includes at least one flap. In this first preferred embodiment, there are three flaps. First flap 171 is approximately triangular, and extends from first wall 141 adjacent the opening 106 to a first tip 176, and is connected to first wall 141 via a first hinge 181. In FIG. 1 and FIG. 3, first flap 171 is shown outside the cavity 105 for clarity, as this is how cap 101 may be manufactured. In FIGS. 5-7, first flap 171 is shown extending into the cavity 105, having pivoted from the position shown in FIG. 1 about hinge 181.

Figure 4:
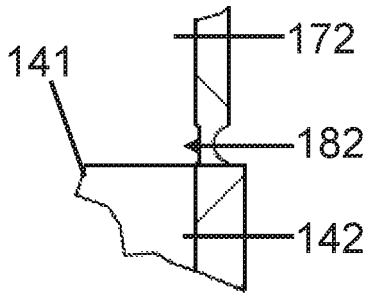
FIG. 4 is an enlarged view of the detail B of the rebar cap of FIG. 3.

Second flap 172 is approximately triangular, and extends from second wall 142 adjacent the opening 106 to a second tip 177, and is connected to second wall 142 via a second hinge 182. In FIGS. 1 and 3, second flap 172 is shown outside the cavity 105 for clarity, as this is how cap 101 may be manufactured. In FIGS. 5 to 7, second flap 172 is shown extending into the cavity 105 at an acute angle α, having pivoted from the position shown in FIG. 1 about hinge 182. FIG. 4 shows more detail of this first preferred embodiment of a hinge 182. In this first preferred embodiment, second flap 172 is integrally formed with second wall 142 from a plastics material, with hinge 182 consisting of a thinner section of material. This hinge 182 is designed to allow second flap 172 to rotate from its fabrication position (as shown in FIGS. 1, 3, and 4) to its use position (as shown in FIGS. 5 to 7) without compression of the plastics material, thus providing for a repeatable pivoting motion.

Third flap 173 is approximately triangular, and extends from third wall 143 adjacent the opening 106 to a third tip 178, and is connected to third wall 143 via a third hinge 183. In FIG. 1 and FIG. 3, third flap 173 is shown outside the cavity 105 for clarity, as this is how cap 101 may be manufactured. In FIGS. 5 to 7, third flap 173 is shown extending into the cavity 105, having pivoted from the position shown in FIG. 1 about hinge 183.

In preparation for use, each flap is rotated about its respective pivot to a position in which it extends partially across the opening 106, or into the cavity 105.

FIGS. 5 to 7 shows how the cap 101 engages with the free end 111 of a rebar 110. The opening 106 is placed over the free end 111 of the rebar 110, and the cap 101 is pushed down into place, either by hand, or by impact of a tool such as a hammer. The free end 111 pushes on the tip of each flap, causing each flap to rotate about its respective hinge, decreasing angle α. When the free end 111 meets the tapered fins, its movement into the cavity 105 is stopped. By including three fins, as in this first preferred embodiment, the free end 111 of rebar 110 is effectively centred in the cavity 105.

In use, the tip of each flap is resting on the side of rebar 110, as most clearly shown in FIG. 7. No significant deformation of the flaps has occurred, because each tip has reached this position by rotation of the flap about its hinge. If the cap 101 is moved in a direction including an upwards component, as indicated by arrow A in FIGS. 5 and 6, the side wall of rebar 110 pulls each tip by friction in the opposite direction to arrow A. This causes each flap to rotate about its hinge, increasing angle α. However, because angle α is an acute angle, and the length of the flaps is constant, an attempt to increase angle α moves the tip further away from the wall, and closer to the central axis of the cavity 105. This is where rebar 110 is located, so the effect of attempting to move the cap 101 in the direction of arrow A relative to the rebar 110 is to increase the pressure of the tips on the side of the rebar, engaging it even more securely with the cap 101.

When a user wants to deliberately remove the cap 101, this can be achieved by decreasing the angle α for one of the flaps, so that its tip disengages from the side of the rebar. This could be achieved by means of a separate tool. Alternatively, cap 101 could be manufactured to include a lever adjacent one of the hinges, adapted to rotate that flap to disengage the rebar. When engaged with certain types of rebar incorporating a threaded outer surface, it may be possible to remove the cap 101 by un-screwing it, so that the tip of each flap travels along the thread grooves until it disengages the free end 111 of the rebar 110.

The flaps engage with the rebar 110 further down than the free end 111. This is advantageous when the free end 111 of the rebar 110 has been deformed, for example by being hammered into place.

The cap of the present invention can be used without modification for different sizes and shapes of rebar, including standard 10 mm, 12 mm, 16 mm, 22 mm or 35 mm diameter rods. This is because the diameter of the space between the tips of the flaps is automatically adjusted by rotation of each flap about its hinge as the cap is pressed over the end of the rebar. A wider rebar will push the flaps to a smaller angle α, but still be locked into the cap.

The triangular first preferred embodiment is also suitable for use with a waratah post. Cap 101 is pressed down on to the top of a waratah post, with each of the three blades of the waratah post passing between a pair of adjacent flaps of the cap 101. The sides of these flaps engage with the side walls of the waratah post blades, pivoting the flaps, and locking the waratah post in place.

Optionally, holes (not shown) may be included in at least one wall, so that a securing device (such as a cable tie or padlock) can be inserted through the hole and a corresponding hole in the rebar or waratah post, to add extra security against removal of the cap 101 from the rebar 110.

Second Preferred Embodiment

Figure 8:
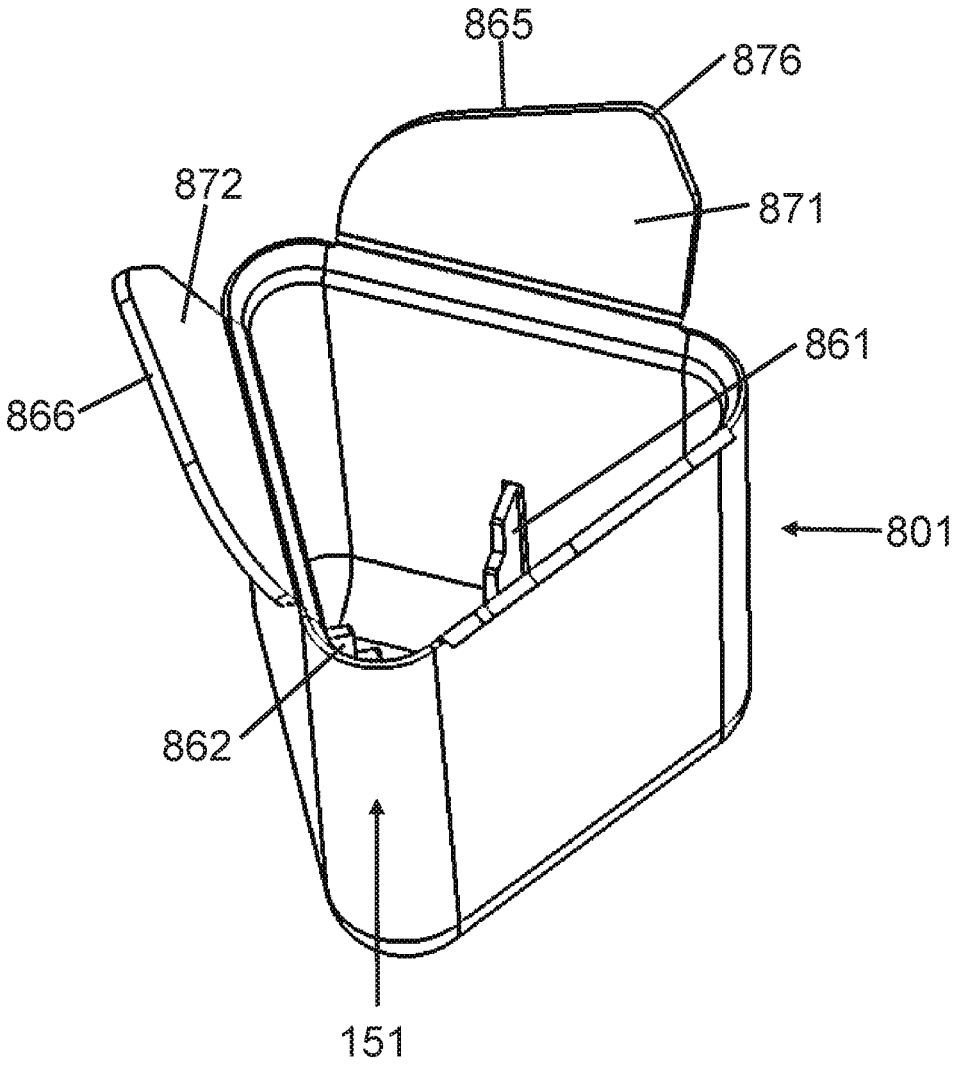
FIG. 8 is a perspective view of a second preferred embodiment of a rebar cap according to the present invention, in an open configuration.
Figure 9:
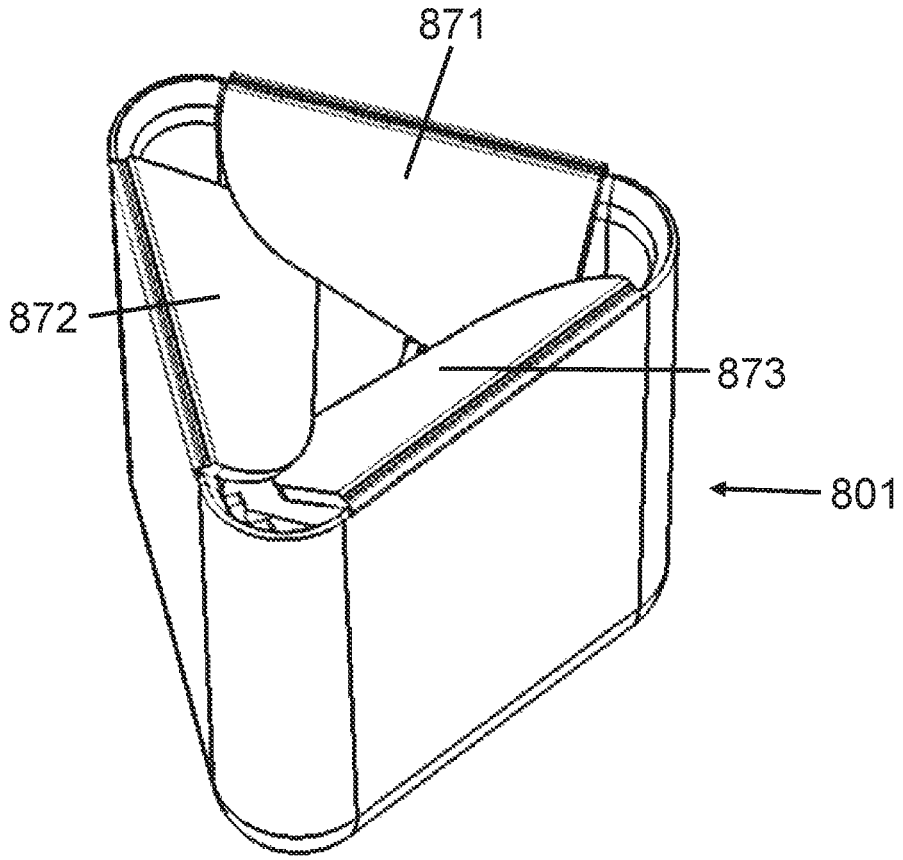
FIG. 9 is a perspective view of the rebar cap of FIG. 8, in a closed configuration.

A second preferred embodiment shown in FIGS. 8 and 9 replicates many of the features of the first preferred embodiment. Features not specifically described as being different may be as described with reference to the first preferred embodiment and shown in detail in any of FIGS. 1 to 7, and corresponding reference numerals are used.

FIG. 8 shows a cap 801 in an open configuration. Cap 801 includes a body 102 including an end 103 and at least one wall 104. The at least one wall 104 forms an elongated hollow prism (which may be about 70 mm long), closed at one end by end 103 to form a cavity 105 with an opening 106 at the distal end of the body 102 from end 103. In this second preferred embodiment, there are three walls:—first wall 141, second wall 142 and third wall 143. The three walls are of equal width (preferably about 60 mm), and integrally formed, with the first wall 141 connecting to second wall 142 at a third vertex 153, second wall 142 connecting to third wall 143 at a first vertex 151, and third wall 143 connecting to first wall 141 at a second vertex 152. Preferably the three vertices are rounded, as shown in FIG. 2. The rounded triangular structure of body 102 is preferred because it can be easily manufactured to provide the necessary strength to withstand the impact of someone falling on it, with minimal structural weak points.

Body 102 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

The end 103 may optionally include at least one reinforced section (not shown) to increase its strength. This may be achieved by increasing or varying the thickness of the end 103, or by including a section made from a different material (such as a metal disc). The exact characteristics of the end 103 may be varied, as will be apparent to one skilled in the art, to comply with regulatory requirements in different jurisdictions. For example, compliance with the U.S. and European standard for withstanding a load of 250 pounds (~113 kg) dropped from 10 feet (~3 m) may be achieved by including a metal disc, as is known in the prior art.

In the cavity 105, near end 103, is at least one fin. In this second preferred embodiment, there are three fins. First fin 861 extends from the centre of first wall 141 towards first vertex 151, stopping at or before the central axis of body 102, and is contiguous with end 103. First fin 861 tapers in steps towards an end point partway along first wall 141 towards opening 106, so that it does not protrude so far into cavity 105 away from end 103. First fin 861 does not extend the entire length of the body 102. Second fin 862 extends from the centre of second wall 142 towards second vertex 152, stopping at or before the central axis of body 102, and is contiguous with end 103. Second fin 862 tapers in steps towards and end point partway along second wall 142 towards opening 106, so that it does not protrude so far into cavity 105 away from end 103. Second fin 862 does not extend the entire length of the body 102. Third fin 863 extends from the centre of third wall 143 towards third vertex 153, stopping at or before the central axis of body 102, and is contiguous with end 103. The third fin (not shown) tapers in steps towards an end point partway along third wall 143 towards opening 106, so that it does not protrude so far into cavity 105 away from end 103. The third fin does not extend the entire length of the body 102.

This second preferred embodiment differs from the first preferred embodiment in that the three fins do not extend as far towards the opening 106 as in the first preferred embodiment. This may have an advantage in allowing more length of the rebar 110 to enter the cavity 105 before the free end 111 engages with the fins, increasing the distance between the point at which the rebar 110 engages with the flaps and the point at which the free end 111 engages with the fins, reducing the risk of the cap rotating about a cross-section of the rebar 110.

This second preferred embodiment differs from the first preferred embodiment in that the tapering of the three fins is in a series of steps. This may have an advantages in engaging with a free end 111 of rebar 110 with a reduced risk of one or more of the fins deforming.

The three fins are preferably integrally formed with the body 102. The advantage of the three fins being contiguous with end 103 is that they thus provide additional structural support to end 103, improving its effective strength when it receives an impact.

Near the opening 106, the wall 104 includes at least one flap. In this second preferred embodiment, there are three flaps. First flap 871 extends from first wall 141 adjacent the opening 106, and is connected to first wall 141 via a first hinge 181. The shape of first flap 871 in this second preferred embodiment differs from the first preferred embodiment. First flap 871 is asymmetric, extending to a first tip 876 which is offset from the centre line of first wall 141, and providing a first engagement edge 865.

Second flap 872 extends from second wall 142 adjacent the opening 106, and is connected to second wall 142 via a second hinge 182. The shape of second flap 872 in this second preferred embodiment differs from the first preferred embodiment. Second flap 872 is asymmetric, extending to a second tip 877 which is offset from the centre line of second wall 142, and providing a second engagement edge 866.

Third flap 873 extends from third wall 143 adjacent the opening 106, and is connected to third wall 143 via a third hinge 183. The shape of third flap 873 in this second preferred embodiment differs from the first preferred embodiment. Third flap 873 is asymmetric, extending to a third tip 878 which is offset from the centre line of third wall 143, and providing a third engagement edge 867.

In preparation for use, each flap is rotated about its respective pivot to a position in which it extends partially across the opening 106, or into the cavity 105. Adjacent flaps overlap each other, so that first tip 876 lies under third engagement edge 867, second tip 877 lies under first engagement edge 865, and third tip 878 lies under second engagement edge 866. This overlapping holds the flaps in position across the opening 106, so the cap is ready for use.

FIG. 9 shows the cap 801 in a closed configuration, as if engaged with a rebar (not shown). When cap 801 is pushed over the free end of a rebar, the free end pushes on the engagement edge of each flap, causing each flap to rotate about its respective hinge. When the free end meets a step on the tapered fins, its movement into the cavity 105 is stopped. By including three fins, as in this second preferred embodiment, the free end of the rebar is effectively centred in the cavity 105.

In use, the engagement edge of each flap is resting on the side of rebar. No significant deformation of the flaps has occurred, because each engagement edge has reached this position by rotation of the flap about its hinge. If the cap 801 is moved in a direction including an upwards component, the side wall of rebar pulls each engagement edge by friction, causing each flap to rotate about its hinge, increasing the pressure of the engagement edges on the side of the rebar, engaging it even more securely with the cap 801.

Third Preferred Embodiment

Figure 10:
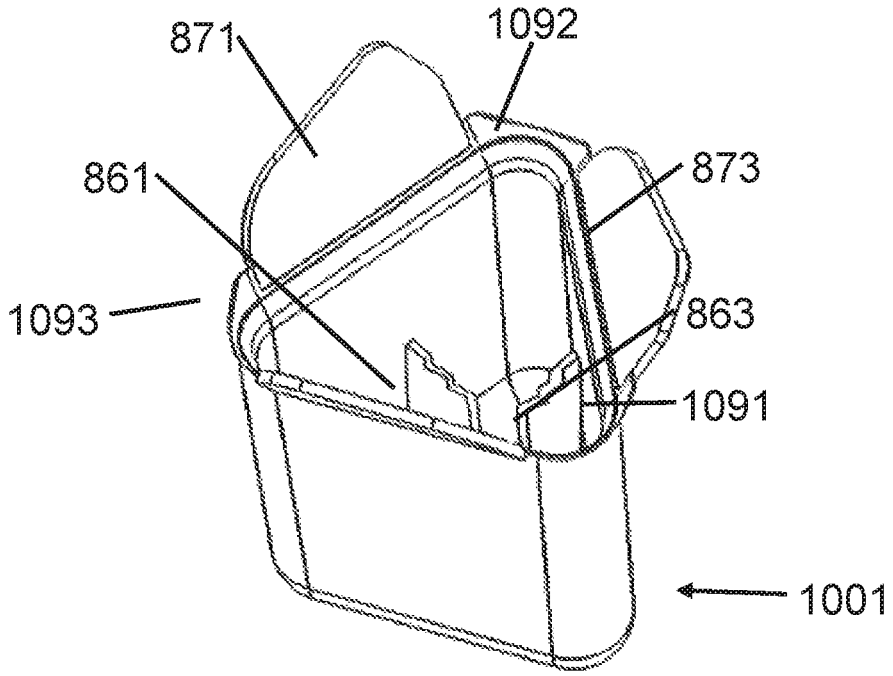
FIG. 10 is a perspective view of a third preferred embodiment of a rebar cap according to the present invention, in an open configuration.

A third preferred embodiment shown in FIG. 10 replicates many of the features of the first preferred embodiment. Features not specifically described as being different may be as described with reference to the first preferred embodiment and shown in detail in any of FIGS. 1 to 7, and corresponding reference numerals are used. The third preferred embodiment is similar to the second preferred embodiment.

FIG. 10 shows a cap 1001 in an open configuration; this configuration is used for clarity, although the manufactured product may not appear in this configuration, as described below. Cap 1001 includes a body 102 including an end 103 and at least one wall 104. The at least one wall 104 forms an elongated hollow prism (which may be about 70 mm long), closed at one end by end 103 to form a cavity 105 with an opening 106 at the distal end of the body 102 from end 103. In this third preferred embodiment, there are three walls:—first wall 141, second wall 142 and third wall 143. The three walls are of equal width (preferably about 60 mm), and integrally formed, with the first wall 141 connecting to second wall 142 at a third vertex 153, second wall 142 connecting to third wall 143 at a first vertex 151, and third wall 143 connecting to first wall 141 at a second vertex 152. Preferably the three vertices are rounded, as shown in FIG. 2. The rounded triangular structure of body 102 is preferred because it can be easily manufactured to provide the necessary strength to withstand the impact of someone falling on it, with minimal structural weak points.

Body 102 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

The end 103 may optionally include at least one reinforced section (not shown) to increase its strength. This may be achieved by increasing or varying the thickness of the end 103, or by including a section made from a different material (such as a metal disc). The exact characteristics of the end 103 may be varied, as will be apparent to one skilled in the art, to comply with regulatory requirements in different jurisdictions. For example, compliance with the U.S. and European standard for withstanding a load of 250 pounds (~113 kg) dropped from 10 feet (~3 m) may be achieved by including a metal disc, as is known in the prior art.

In the cavity 105, near end 103, is at least one fin. In this third preferred embodiment, there are three fins. First fin 861 extends from the centre of first wall 141 towards first vertex 151, stopping at or before the central axis of body 102, and is contiguous with end 103. First fin 861 tapers in steps towards an end point partway along first wall 141 towards opening 106, so that it does not protrude so far into cavity 105 away from end 103. First fin 861 does not extend the entire length of the body 102. Second fin 862 extends from the centre of second wall 142 towards second vertex 152, stopping at or before the central axis of body 102, and is contiguous with end 103.

Second fin 862 tapers in steps towards and end point partway along second wall 142 towards opening 106, so that it does not protrude so far into cavity 105 away from end 103. Second fin 862 does not extend the entire length of the body 102. Third fin 863 extends from the centre of third wall 143 towards third vertex 153, stopping at or before the central axis of body 102, and is contiguous with end 103. The third fin (not shown) tapers in steps towards an end point partway along third wall 143 towards opening 106, so that it does not protrude so far into cavity 105 away from end 103. The third fin does not extend the entire length of the body 102.

This third preferred embodiment differs from the first preferred embodiment in that the three fins do not extend as far towards the opening 106 as in the first preferred embodiment. This may have an advantage in allowing more length of the rebar 110 to enter the cavity 105 before the free end 111 engages with the fins, increasing the distance between the point at which the rebar 110 engages with the flaps and the point at which the free end 111 engages with the fins, reducing the risk of the cap rotating about a cross-section of the rebar 110.

This third preferred embodiment differs from the first preferred embodiment in that the tapering of the three fins is in a series of steps. This may have an advantages in engaging with a free end 111 of rebar 110 with a reduced risk of one or more of the fins deforming.

The three fins are preferably integrally formed with the body 102. The advantage of the three fins being contiguous with end 103 is that they thus provide additional structural support to end 103, improving its effective strength when it receives an impact.

Near the opening 106, the wall 104 includes at least one flap. In this third preferred embodiment, there are three flaps. First flap 871 extends from first wall 141 adjacent the opening 106, and is connected to first wall 141 via a first hinge 181. The shape of first flap 871 in this third preferred embodiment differs from the first preferred embodiment. First flap 871 is asymmetric, extending to a first tip 876 which is offset from the centre line of first wall 141, and providing a first engagement edge 865.

Second flap 872 extends from second wall 142 adjacent the opening 106, and is connected to second wall 142 via a second hinge 182. The shape of second flap 872 in this third preferred embodiment differs from the first preferred embodiment. Second flap 872 is asymmetric, extending to a second tip 877 which is offset from the centre line of second wall 142, and providing a second engagement edge 866.

Third flap 873 extends from third wall 143 adjacent the opening 106, and is connected to third wall 143 via a third hinge 183. The shape of third flap 873 in this third preferred embodiment differs from the first preferred embodiment. Third flap 873 is asymmetric, extending to a third tip 878 which is offset from the centre line of third wall 143, and providing a third engagement edge 867.

This third preferred embodiment further includes three ties. First tie 1091 extends from second wall 142 adjacent the end of second flap 872 closest to first vertex 151, around first vertex 151 to extend from third wall 143 adjacent the end of third flap 873. Second tie 1092 extends from third wall 143 adjacent the end of third flap 873 closest to second vertex 152, around second vertex 152 to extend from first wall 141 adjacent the end of first flap 871 closest to second vertex 152. Third tie 1092 extends from first wall 141 adjacent the end of first flap 871 closest to third vertex 153, around third vertex 153 to extend from second wall 142 adjacent the end of second flap 872 closest to third vertex 153. When the cap 1001 is manufactured from plastic, during the cooling process the three ties pull the three flaps into a semi-closed configuration in which first tip 871 is closer to the central longitudinal axis of cap 1001 than is first wall 141, second tip 872 is closer to the central longitudinal axis of cap 1001 than is second wall 142, and third tip 873 is closer to the central longitudinal axis of cap 1001 than is third wall 143. This means that the cap is ready for use, with each flap extending partially across the opening 106.

When cap 1001 is pushed over the free end of a rebar, the free end pushes on the engagement edge of each flap, causing each flap to rotate about its respective hinge. When the free end meets a step on the tapered fins, its movement into the cavity 105 is stopped. By including three fins, as in this third preferred embodiment, the free end of the rebar is effectively centred in the cavity 105.

In use, the engagement edge of each flap is resting on the side of rebar. No significant deformation of the flaps has occurred, because each engagement edge has reached this position by rotation of the flap about its hinge. If the cap 1001 is moved in a direction including an upwards component, the side wall of rebar pulls each engagement edge tip by friction, causing each flap to rotate about its hinge, increasing the pressure of the engagement edges on the side of the rebar, engaging it even more securely with the cap 1001.

Fourth Preferred Embodiment

Figure 11:
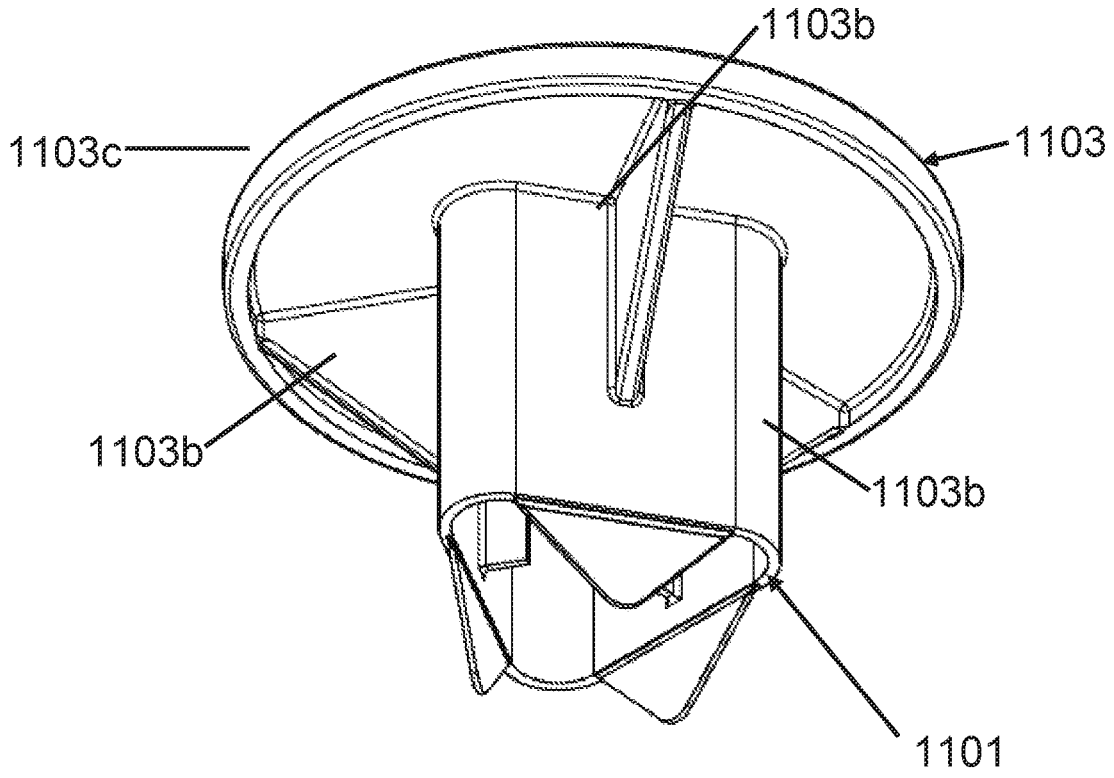
FIG. 11 is a lower perspective view of a fourth preferred embodiment of a rebar cap according to the present invention.
Figure 12:
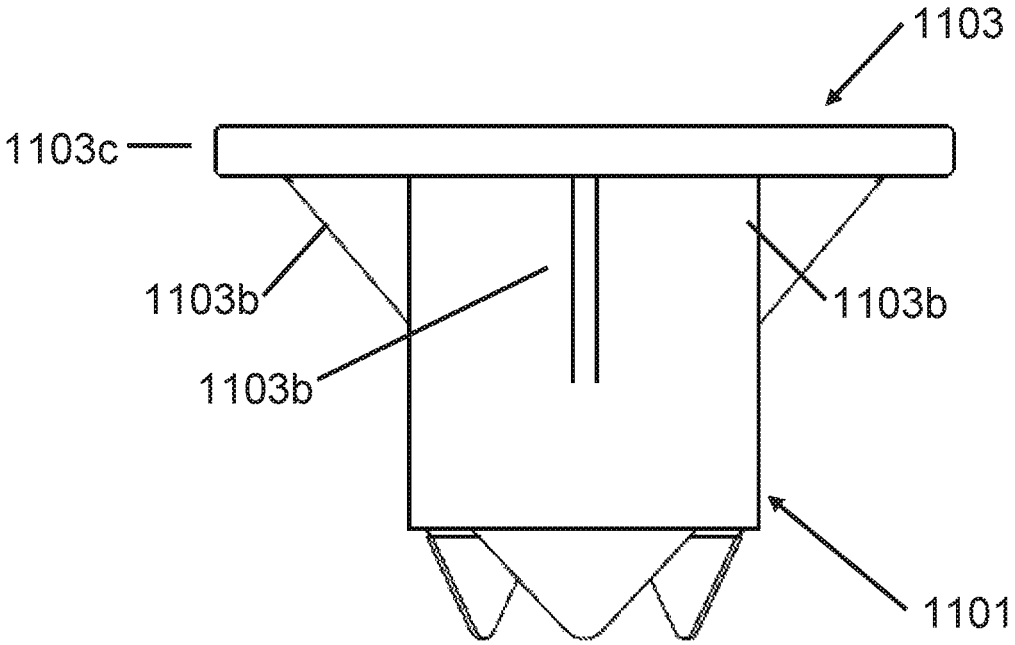
FIG. 12 is a side view of the rebar cap of FIG. 11.
Figure 13:
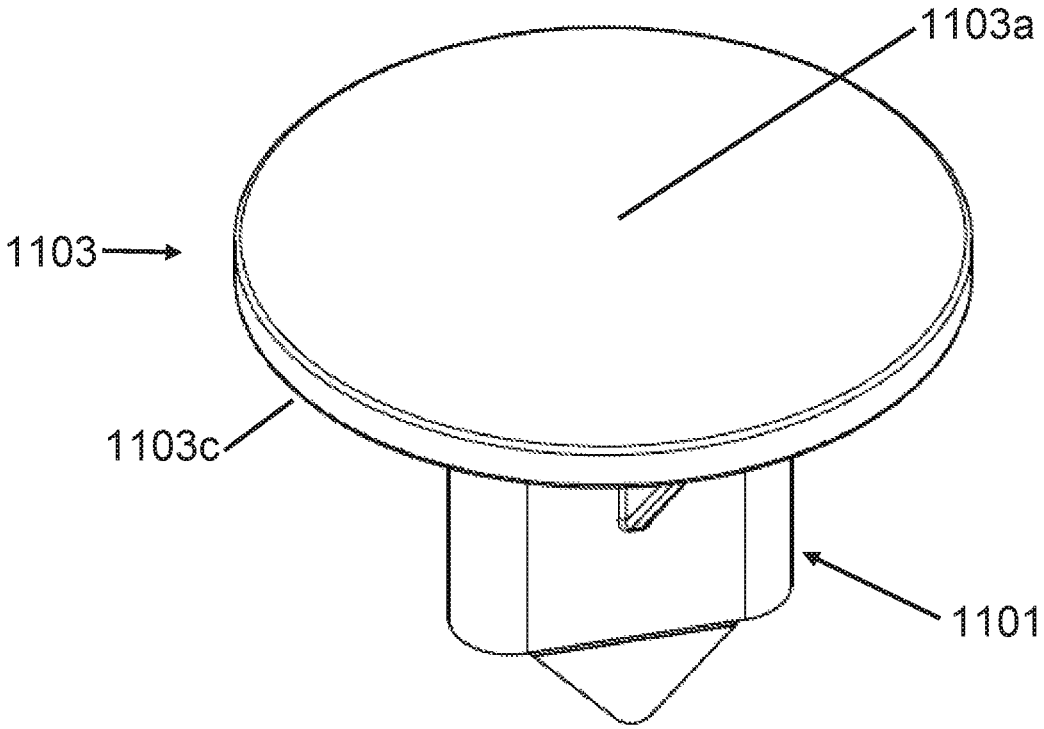
FIG. 13 is an upper perspective view of the rebar cap of FIG. 11.

A fourth preferred embodiment shown in FIGS. 11 to 13 replicates many of the features of the first preferred embodiment. Features not specifically described as being different may be as described with reference to the first preferred embodiment and shown in detail in any of FIGS. 1 to 7, and corresponding reference numerals are used.

Cap 1101 includes a body 102 including an end plate 1103, and at least one wall 104. The at least one wall 104 forms an elongated hollow prism (which may be about 70 mm long), closed at one end by end plate 1103 to form a cavity 105 with an opening 106 at the distal end of the body 102 from end 1103. In this fourth preferred embodiment, there are three walls:—first wall 141, second wall 142 and third wall 143. The three walls are of equal width (preferably about 60 mm), and integrally formed, with the first wall 141 connecting to second wall 142 at a third vertex 153, second wall 142 connecting to third wall 143 at a first vertex 151, and third wall 143 connecting to first wall 141 at a second vertex 152. Preferably the three vertices are rounded, as shown in FIG. 2. The rounded triangular structure of body 102 is preferred because it can be easily manufactured to provide the necessary strength to withstand the impact of someone falling on it, with minimal structural weak points.

Body 102 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

This fourth preferred embodiment differs from the first preferred embodiment in that end plate 1103 extends beyond the circumference of the walls, to provide a top plate surface 1103*a*. As shown in FIG. 13, this may be circular, having a diameter of at least 4 inches (10.16 cm) to comply with U.S. regulations. Alternatively, the top plate surface may be a different shape, such as square or hexagonal. In order to increase the strength of end plate 1103, a series of struts 1103*b* may extend from the walls of body 102 towards the perimeter of end plate 1103. End plate 1103 may also include a thicker border 1103*c* around its perimeter, also to increase the strength of end plate 1103.

The end plate 1103 may optionally include at least one reinforced section (not shown) to increase its strength. This may be achieved by increasing or varying the thickness of the end plate 1103, or by including a section made from a different material (such as a metal disc). For example, compliance with the U.S. and European standard for withstanding a load of 250 pounds (~113 kg) dropped from 10 feet (~3 m) may be achieved by including a metal disc, as is known in the prior art.

In the cavity 105, near end plate 1103, is at least one fin. In this fourth preferred embodiment, there are three fins. First fin 161 extends from the centre of first wall 141 towards first vertex 151, stopping at or before the central axis of body 102, and is contiguous with end plate 1103. First fin 161 tapers towards opening 106, so that it does not protrude so far into cavity 105 away from end plate 1103. First fin 161 does not extend the entire length of the body 102. Second fin 162 extends from the centre of second wall 142 towards second vertex 152, stopping at or before the central axis of body 102, and is contiguous with end plate 1103. Second fin 162 tapers towards opening 106 (as most clearly shown in FIGS. 3 and 6), so that it does not protrude so far into cavity 105 away from end plate 1103. Second fin 162 does not extend the entire length of the body 102. Third fin 163 extends from the centre of third wall 143 towards third vertex 153, stopping at or before the central axis of body 102, and is contiguous with end plate 1103. Third fin 163 tapers towards opening 106, so that it does not protrude so far into cavity 105 away from end plate 1103. Third fin 163 does not extend the entire length of the body 102.

The three fins are preferably integrally formed with the body 102. The advantage of the three fins being contiguous with end plate 1103 is that they thus provide additional structural support to end plate 1103, improving its effective strength when it receives an impact.

Near the opening 106, the wall 104 includes at least one flap. In this fourth preferred embodiment, there are three flaps. First flap 171 is approximately triangular, and extends from first wall 141 adjacent the opening 106 to a first tip 176, and is connected to first wall 141 via a first hinge 181.

In FIG. 1 and FIG. 3, first flap 171 is shown outside the cavity 105 for clarity, as this is how cap 101 may be manufactured. In FIGS. 5-7, first flap 171 is shown extending into the cavity 105, having pivoted from the position shown in FIG. 1 about hinge 181.

Second flap 172 is approximately triangular, and extends from second wall 142 adjacent the opening 106 to a second tip 177, and is connected to second wall 142 via a second hinge 182. In FIGS. 1 and 3, second flap 172 is shown outside the cavity 105 for clarity, as this is how cap 101 may be manufactured. In FIGS. 5 to 7, second flap 172 is shown extending into the cavity 105 at an acute angle $\alpha$, having pivoted from the position shown in FIG. 1 about hinge 182. FIG. 4 shows more detail of this fourth preferred embodiment of a hinge 182. In this fourth preferred embodiment, second flap 172 is integrally formed with second wall 142 from a plastics material, with hinge 182 consisting of a thinner section of material. This hinge 182 is designed to allow second flap 172 to rotate from its fabrication position (as shown in FIGS. 1, 3, and 4) to its use position (as shown in FIGS. 5 to 7) without compression of the plastics material, thus providing for a repeatable pivoting motion.

Third flap 173 is approximately triangular, and extends from third wall 143 adjacent the opening 106 to a third tip 178, and is connected to third wall 143 via a third hinge 183. In FIG. 1 and FIG. 3, third flap 173 is shown outside the cavity 105 for clarity, as this is how cap 101 may be manufactured. In FIGS. 5 to 7, third flap 173 is shown extending into the cavity 105, having pivoted from the position shown in FIG. 1 about hinge 183.

In preparation for use, each flap is rotated about its respective pivot to a position in which it extends partially across the opening 106, or into the cavity 105.

FIGS. 5 to 7 shows how the cap 101 engages with the free end 111 of a rebar 110. The opening 106 is placed over the free end 111 of the rebar 110, and the cap 101 is pushed down into place, either by hand, or by impact of a tool such as a hammer. The free end 111 pushes on the tip of each flap, causing each flap to rotate about its respective hinge, decreasing angle $\alpha$. When the free end 111 meets the tapered fins, its movement into the cavity 105 is stopped. By including three fins, as in this fourth preferred embodiment, the free end 111 of rebar 110 is effectively centred in the cavity 105.

In use, the tip of each flap is resting on the side of rebar 110, as most clearly shown in FIG. 7. No significant deformation of the flaps has occurred, because each tip has reached this position by rotation of the flap about its hinge. If the cap 101 is moved in a direction including an upwards component, as indicated by arrow A in FIGS. 5 and 6, the side wall of rebar 110 pulls each tip by friction in the opposite direction to arrow A. This causes each flap to rotate about its hinge, increasing angle $\alpha$. However, because angle $\alpha$ is an acute angle, and the length of the flaps is constant, an attempt to increase angle $\alpha$ moves the tip further away from the wall, and closer to the central axis of the cavity 105. This is where rebar 110 is located, so the effect of attempting to move the cap 101 in the direction of arrow A relative to the rebar 110 is to increase the pressure of the tips on the side of the rebar, engaging it even more securely with the cap 101.

When a user wants to deliberately remove the cap 101, this can be achieved by decreasing the angle $\alpha$ for one of the flaps, so that its tip disengages from the side of the rebar. This could be achieved by means of a separate tool. Alternatively, cap 101 could be manufactured to include a lever adjacent one of the hinges, adapted to rotate that flap to disengage the rebar. When engaged with certain types of rebar incorporating a threaded outer surface, it may be possible to remove the cap 101 by un-screwing it, so that the tip of each flap travels along the thread grooves until it disengages the free end 111 of the rebar 110.

The flaps engage with the rebar 110 further down than the free end 111. This is advantageous when the free end 111 of the rebar 110 has been deformed, for example by being hammered into place.

Fifth Preferred Embodiment

Figure 14:
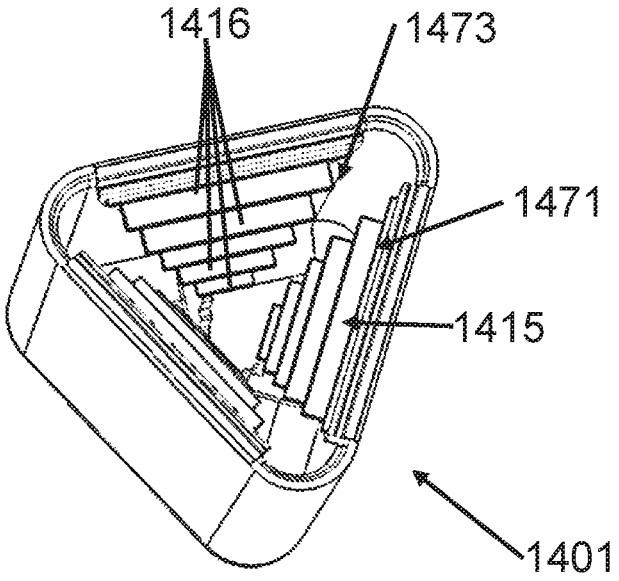
FIG. 14 is a perspective view of a fifth preferred embodiment of a rebar cap according to the present invention, in a closed configuration.
Figure 15:
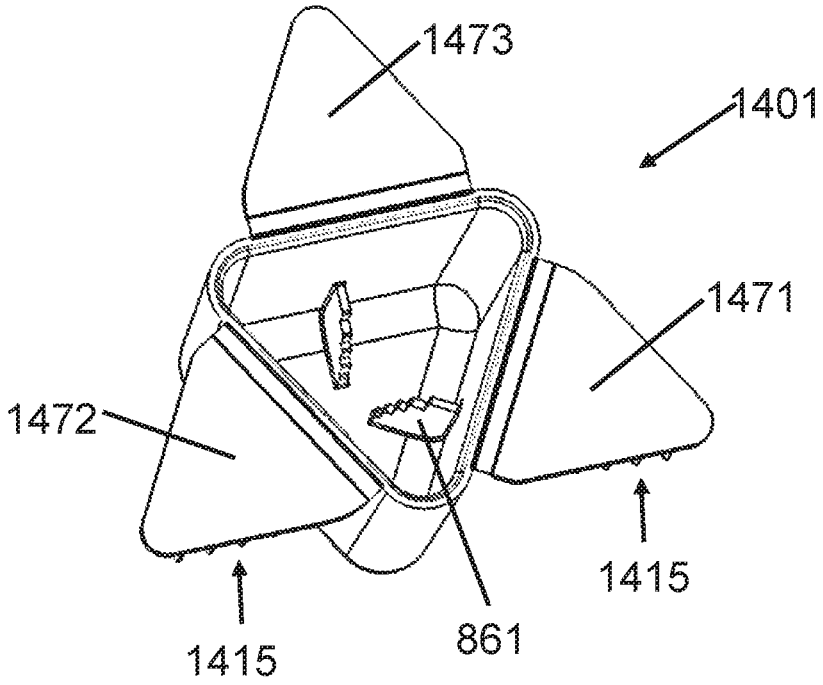
FIG. 15 is a perspective view of the rebar cap of FIG. 14, in an open configuration.

A fifth preferred embodiment shown in FIGS. 14 and 15 replicates many of the features of the first preferred embodiment, and some features of the second preferred embodiment. Features not specifically described as being different may be as described with reference to the first preferred embodiment and shown in detail in any of FIGS. 1 to 7, and corresponding reference numerals are used.

Cap 1401 includes a body 102 including an end 103 and at least one wall 104. The at least one wall 104 forms an elongated hollow prism (which may be about 70 mm long), closed at one end by end 103 to form a cavity 105 with an opening 106 at the distal end of the body 102 from end 103. As in the first preferred embodiment, there are three walls:—first wall 141, second wall 142 and third wall 143. The three walls are of equal width (preferably about 60 mm), and integrally formed, with the first wall 141 connecting to second wall 142 at a third vertex 153, second wall 142 connecting to third wall 143 at a first vertex 151, and third wall 143 connecting to first wall 141 at a second vertex 152. Preferably the three vertices are rounded, as shown in FIG. 2. The rounded triangular structure of body 102 is preferred because it can be easily manufactured to provide the necessary strength to withstand the impact of someone falling on it, with minimal structural weak points.

Body 102 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

The end 103 may optionally include at least one reinforced section (not shown) to increase its strength. This may be achieved by increasing or varying the thickness of the end 103, or by including a section made from a different material (such as a metal disc). The exact characteristics of the end 103 may be varied, as will be apparent to one skilled in the art, to comply with regulatory requirements in different jurisdictions. For example, compliance with the U.S. and European standard for withstanding a load of 250 pounds (~113 kg) dropped from 10 feet (~3 m) may be achieved by including a metal disc, as is known in the prior art.

In the cavity 105, near end 103, is at least one fin. In this fifth preferred embodiment, there are three fins, similar to the fins of the second preferred embodiment, and as shown in FIGS. 8 and 9. First fin 861 extends from the centre of first wall 141 towards first vertex 151, stopping at or before the central axis of body 102, and is contiguous with end 103. First fin 861 tapers in steps towards an end point partway along first wall 141 towards opening 106, so that it does not protrude so far into cavity 105 away from end 103. First fin 861 does not extend the entire length of the body 102. Second fin 862 extends from the centre of second wall 142 towards second vertex 152, stopping at or before the central axis of body 102, and is contiguous with end 103. Second fin 862 tapers in steps towards and end point partway along second wall 142 towards opening 106, so that it does not protrude so far into cavity 105 away from end 103. Second fin 862 does not extend the entire length of the body 102. Third fin 863 extends from the centre of third wall 143 towards third vertex 153, stopping at or before the central axis of body 102, and is contiguous with end 103. The third fin (not shown) tapers in steps towards an end point partway along third wall 143 towards opening 106, so that it does not protrude so far into cavity 105 away from end 103. The third fin does not extend the entire length of the body 102.

As with the second preferred embodiment, this fifth preferred embodiment differs from the first preferred embodiment in that the three fins do not extend as far towards the opening 106 as in the first preferred embodiment. This may have an advantage in allowing more length of the rebar 110 to enter the cavity 105 before the free end 111 engages with the fins, increasing the distance between the point at which the rebar 110 engages with the flaps and the point at which the free end 111 engages with the fins, reducing the risk of the cap rotating about a cross-section of the rebar 110.

As with the second preferred embodiment, this fifth preferred embodiment differs from the first preferred embodiment in that the tapering of the three fins is in a series of steps. This may have an advantages in engaging with a free end 111 of rebar 110 with a reduced risk of one or more of the fins deforming.

The three fins are preferably integrally formed with the body 102. The advantage of the three fins being contiguous with end 103 is that they thus provide additional structural support to end 103, improving its effective strength when it receives an impact.

Near the opening 106, the wall 104 includes at least one flap. In this fifth preferred embodiment, there are three flaps. First flap 1471 is approximately triangular, and extends from first wall 141 adjacent the opening 106 to a first tip 176, and is connected to first wall 141 via a first hinge 181. In FIG. 15, first flap 1471 is shown outside the cavity 105 for clarity, as this is how cap 1401 may be manufactured. In FIG. 14, first flap 1471 is shown extending into the cavity 105, having pivoted from the position shown in FIG. 15 about hinge 181.

Second flap 1472 is approximately triangular, and extends from second wall 142 adjacent the opening 106 to a second tip 177, and is connected to second wall 142 via a second hinge 182. In FIG. 15, second flap 1472 is shown outside the cavity 105 for clarity, as this is how cap 1401 may be manufactured. In FIG. 14, second flap 172 is shown extending into the cavity 105 at an acute angle $\alpha$, having pivoted from the position shown in FIG. 15 about hinge 182. FIG. 4 shows more detail of the first preferred embodiment of a hinge 182. As in the first preferred embodiment, second flap 1472 is integrally formed with second wall 142 from a plastics material, with hinge 182 consisting of a thinner section of material. This hinge 182 is designed to allow second flap 172 to rotate from its fabrication position (as shown in FIG. 15) to its use position (as shown in FIG. 14) without compression of the plastics material, thus providing for a repeatable pivoting motion.

Third flap 1473 is approximately triangular, and extends from third wall 143 adjacent the opening 106 to a third tip 178, and is connected to third wall 143 via a third hinge 183. In FIG. 15, third flap 173 is shown outside the cavity 105 for clarity, as this is how cap 1401 may be manufactured. In FIG. 14, third flap 1473 is shown extending into the cavity 105, having pivoted from the position shown in FIG. 15 about hinge 183.

This fifth preferred embodiment differs from the first preferred embodiment in that each of first flap 1471, second flap 1472 and third flap 1473 includes engagement enhancement means 1415 on the face of the flap which faces the centre of the cavity 105 when the cap 1401 is in the closed position shown in FIG. 14. In the highly preferred form shown in FIGS. 14 and 15, these engagement enhancement means 1415 take the form of a series of spines 1416. Spines 1416 run parallel to the hinged edge of each flap, and extend from the face of the flap approximately perpendicular to the face of the flap (or optionally angled slightly towards the respective walls to which that flap is connected). The spines 1416 may be of uniform height, or may decrease in height closer to the tip of the flap.

In preparation for use, each flap is rotated about its respective pivot to a position in which it extends partially across the opening 106, or into the cavity 105.

FIGS. 5 to 7 shows how the cap 1401 engages with the free end 111 of a rebar 110. The opening 106 is placed over the free end 111 of the rebar 110, and the cap 1401 is pushed down into place, either by hand, or by impact of a tool such as a hammer. The free end 111 pushes on the tip of each flap, causing each flap to rotate about its respective hinge, decreasing angle α. When the free end 111 meets the tapered fins, its movement into the cavity 105 is stopped. By including three fins, as in the first preferred embodiment, the free end 111 of rebar 110 is effectively centred in the cavity 105.

In use, either the tip of each flap, or one or more of the spines 1416 is resting on the side of rebar 110. The inclusion of engagement enhancement means 1415 in this fifth preferred embodiment allows the potential for multiple points of contact between the side of the rebar 110 and the flaps, increasing the amount of friction that may be applied between them, and more securely holding cap 1401 on to the free end 111 of rebar 110.

No significant deformation of the flaps occurs, because each flap reaches the engaged position by rotation about its hinge. If the cap 1401 is moved in a direction including an upwards component, as indicated by arrow A in FIGS. 5 and 6, the side wall of rebar 110 pulls each tip by friction in the opposite direction to arrow A. This causes each flap to rotate about its hinge, increasing angle α. However, because angle α is an acute angle, and the length of the flaps is constant, an attempt to increase angle α moves the tip further away from the wall, and closer to the central axis of the cavity 105. This is where rebar 110 is located, so the effect of attempting to move the cap 1401 in the direction of arrow A relative to the rebar 110 is to increase the pressure of the tips on the side of the rebar, engaging it even more securely with the cap 1401.

When a user wants to deliberately remove the cap 1401, this can be achieved by decreasing the angle α for one of the flaps, so that its tip disengages from the side of the rebar. This could be achieved by means of a separate tool. Alternatively, cap 1401 could be manufactured to include a lever adjacent one of the hinges, adapted to rotate that flap to disengage the rebar. When engaged with certain types of rebar incorporating a threaded outer surface, it may be possible to remove the cap 1401 by un-screwing it, so that the tip of each flap travels along the thread grooves until it disengages the free end 111 of the rebar 110.

The flaps engage with the rebar 110 further down than the free end 111. This is advantageous when the free end 111 of the rebar 110 has been deformed, for example by being hammered into place.

Sixth Preferred Embodiment

A sixth preferred embodiment is shown in FIGS. 16 to 20. Features not specifically described as being different may be as described with reference to the first preferred embodiment and shown in detail in any of FIGS. 1 to 7, and corresponding reference numerals are used.

Figure 16:
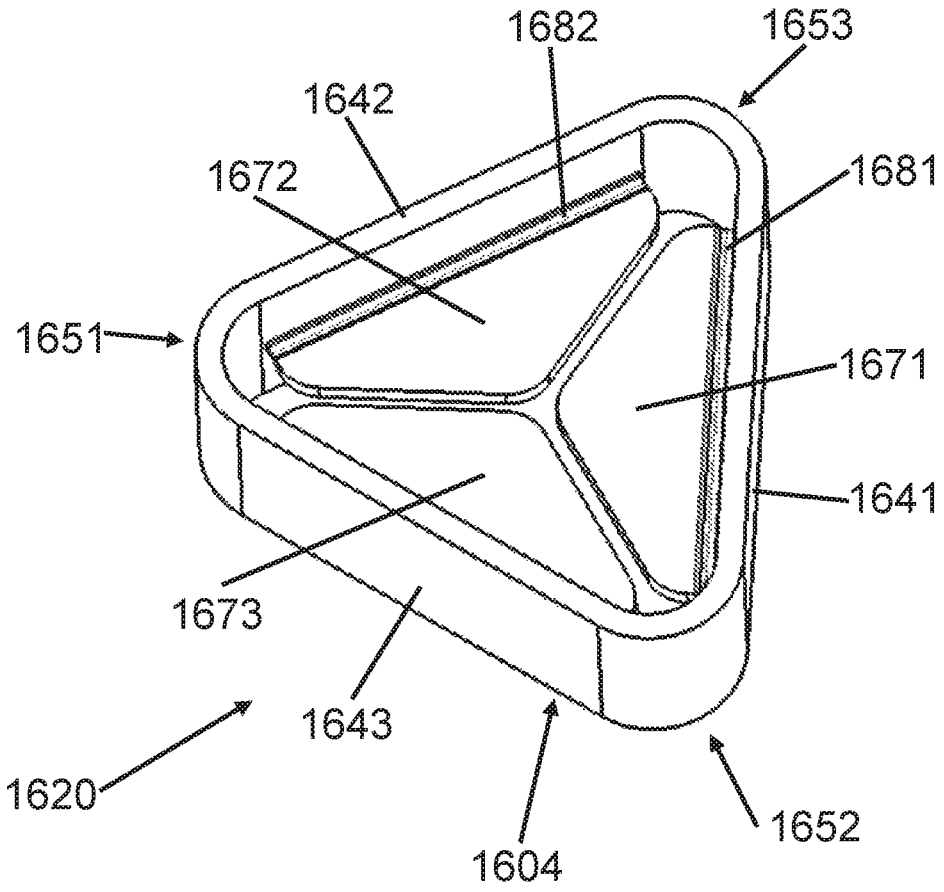
FIG. 16 is a perspective view of an insert according to a sixth preferred embodiment of a rebar cap according to the present invention, in a closed configuration.

An insert 1620, shown in FIG. 16, includes at least one insert wall 1604. The at least one insert wall 1604 forms a hollow prism. In this preferred embodiment, there are three walls: first wall 1641, second wall 1642 and third wall 1643. The three walls are of equal width (preferably about 60 mm), and integrally formed, with the first wall 1641 connecting to second wall 1642 at a third vertex 1653, second wall 1642 connecting to third wall 1643 at a first vertex 1651, and third wall 1643 connecting to first wall 1641 at a second vertex 1652. Preferably the three vertices are rounded. The rounded triangular structure of insert 1620 is preferred because it can be easily manufactured to provide the necessary strength, with minimal structural weak points.

Insert 1620 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

The insert wall 1604 includes at least one flap. In this sixth preferred embodiment, there are three flaps. First flap 1671 is approximately triangular, and extends to a first tip 176 from first wall 1641 at an angle thereto via a first hinge 1681. First hinge 1681 may be located along or near a central cross-section of insert 1620.

Second flap 1672 is approximately triangular, and extends to a second tip 177 from second wall 1642 at an angle thereto via a second hinge 1682.

A hinge in this embodiment may be similar to that shown in FIG. 4 and described in detail in the first preferred embodiment of a hinge 182.

Third flap 1673 is approximately triangular, and extends to a third tip 178 from third wall 1643 at an angle thereto via a third hinge 1683.

Figure 17:
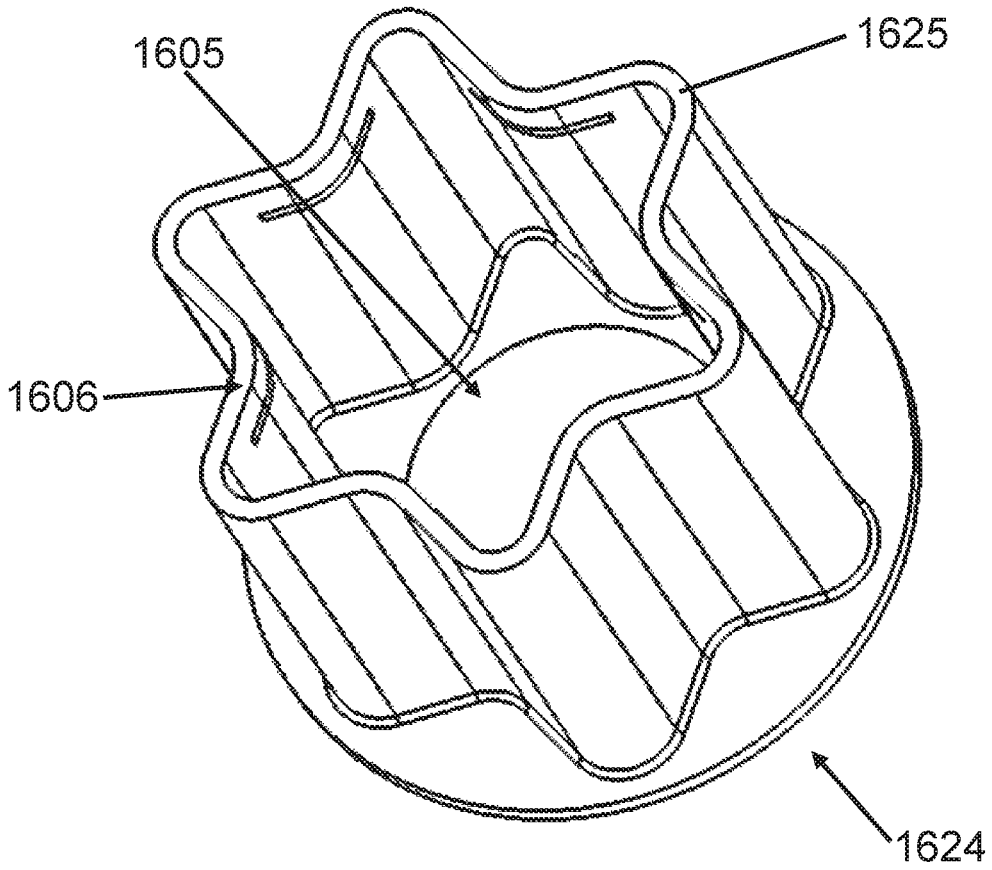
FIG. 17 is a perspective view of a casing according to the sixth preferred embodiment of a rebar cap according to the present invention.

FIG. 17 shows a casing 1624 according to this sixth preferred embodiment of the invention. The casing 1624 includes an end 1603 and at least one casing wall 1625. The at least one casing wall 1625 forms an elongated hollow prism (which may be about 70 mm long), closed at one end by end 1603 to form a cavity 1605 with an opening 1606 at the distal end of the casing 1624 from end 1603.

In this sixth preferred embodiment, casing wall 1625 is in the shape of a rounded six-pointed star. Casing wall 1625 is dimensioned so that a triangular insert 1620 will be a snug push fit into cavity 1605.

Casing 1624 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

Figure 20:
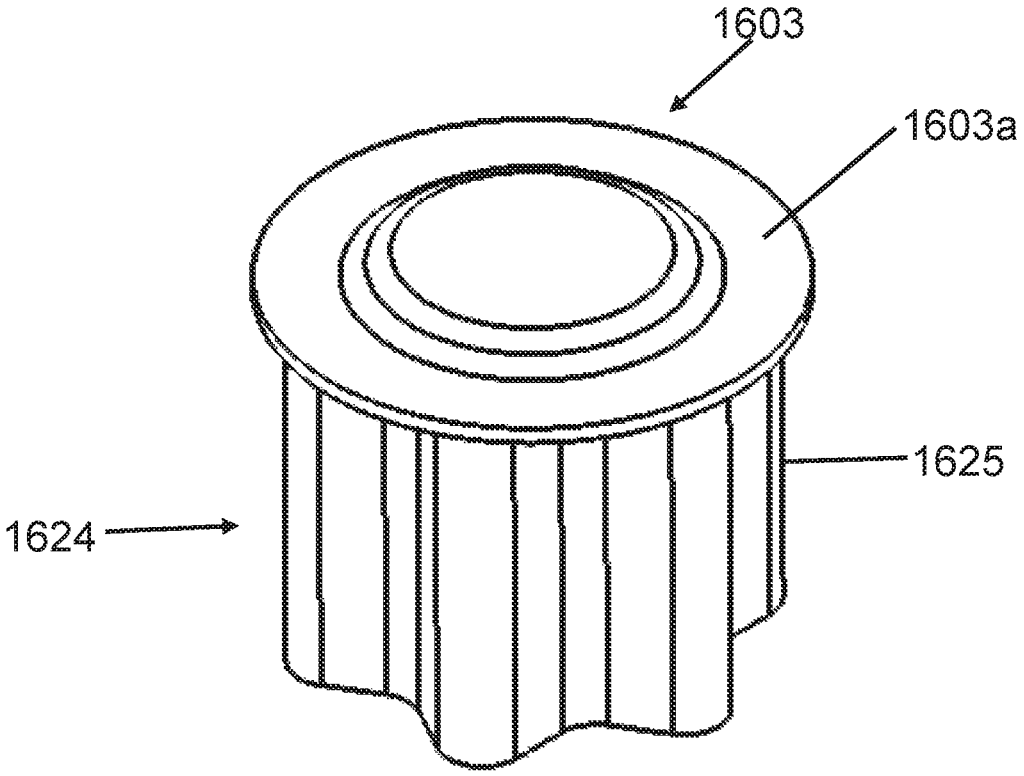
FIG. 20 is a top perspective view of the rebar cap of FIG. 19.

The end 1603 of casing 1624 may extend beyond the circumference of casing wall 1625, to provide a top plate surface 1603*a*. As shown in FIG. 20, this may be circular, having a diameter of at least 4 inches (10.16 cm) to comply with U.S. regulations. Alternatively, the top plate surface may be a different shape, such as square or hexagonal.

The end 1603 of casing 1624 may optionally include at least one reinforced section (not shown) to increase its strength. This may be achieved by increasing or varying the thickness of the end 1603, or by including a section made from a different material (such as a metal disc). The exact characteristics of the end 1603 may be varied, as will be apparent to one skilled in the art, to comply with regulatory requirements in different jurisdictions. For example, compliance with the U.S. and European standard for withstanding a load of 250 pounds (~113 kg) dropped from 10 feet (~3 m) may be achieved by including a metal disc, as is known in the prior art.

Figure 18:
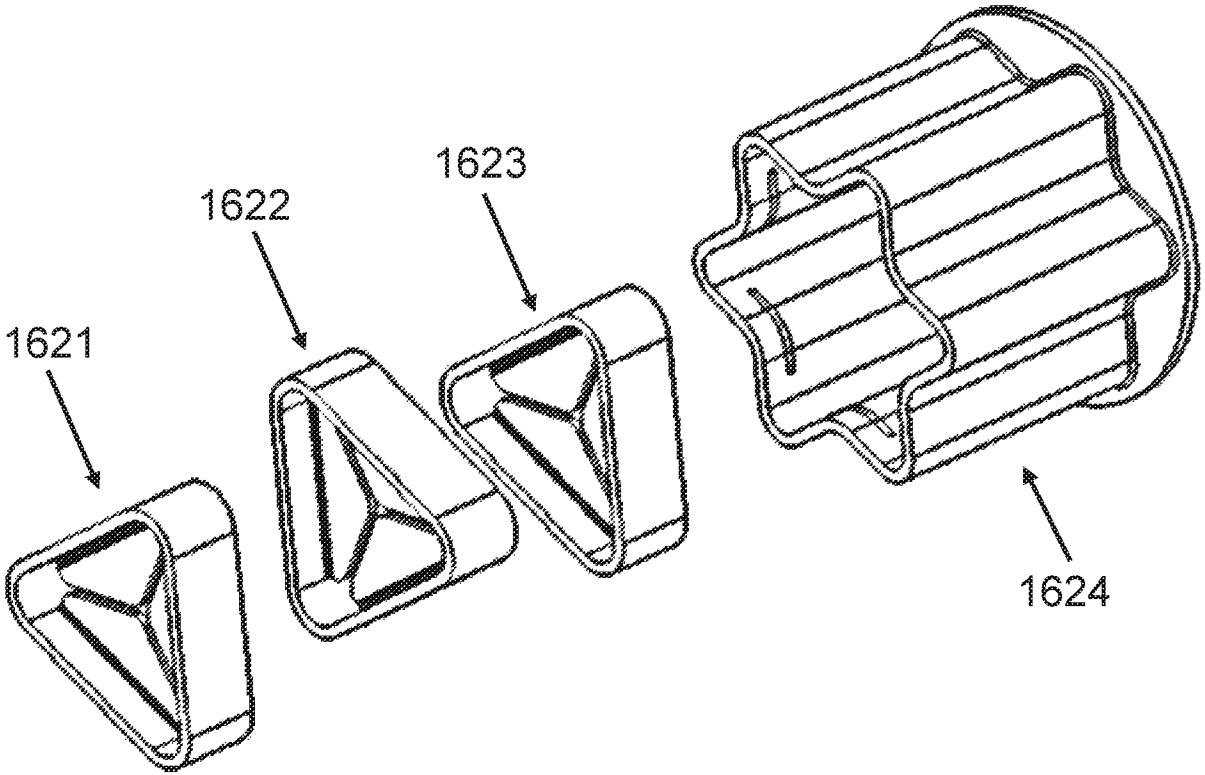
FIG. 18 is an exploded perspective view of the sixth preferred embodiment of a rebar cap according to the present invention, in a closed configuration.

FIG. 18 shows how cap 1601 of the sixth preferred embodiment is assembled, ready for use. Cap 1601 includes a casing 1624, a primary insert 1621, secondary insert 1622 and tertiary insert 1623. Each of primary insert 1621, secondary insert 1622 and tertiary insert 1623 is identical, and as generally described above as insert 1620.

Tertiary insert 1623 slides into cavity 1605, so that an outer surface of tertiary insert wall 1604 engages by friction with the inside of casing wall 1625 near the vertices of tertiary insert wall 1604. Secondary insert 1622 slides into cavity 1605 after tertiary insert 1623 is in place, and is rotated 180° relative to tertiary insert 1623. An outer surface of secondary insert wall 1604 engages by friction with the inside of casing wall 1625 near the vertices of secondary insert wall 1604. Primary insert 1621 slides into cavity 1605 after secondary insert 1622 is in place, and is rotated 180° relative to secondary insert 1622. An outer surface of primary insert wall 1604 engages by friction with the inside of casing wall 1625 near the vertices of primary insert wall 1604.

It will be appreciated by one skilled in the art that the or each insert could be held in place by the use of known techniques such as bonding or adhesives, and that more than three, or as few as two, inserts could be used.

Figure 19:
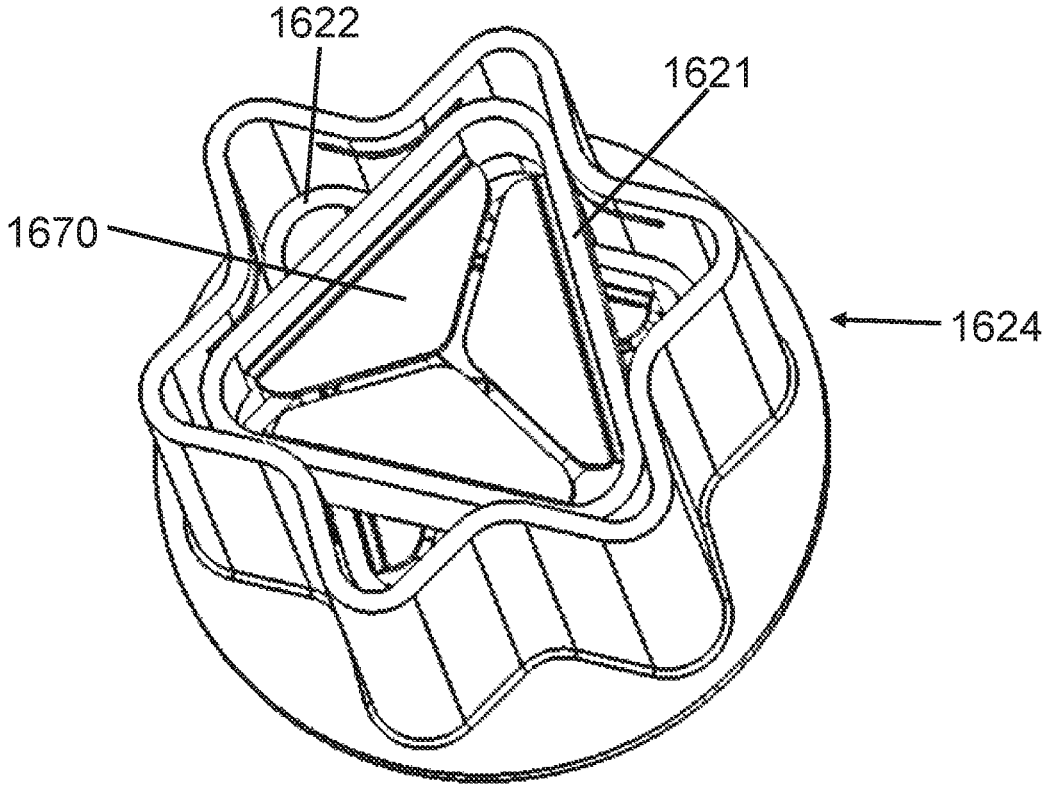
FIG. 19 is a perspective view of the rebar cap of FIG. 18, in a closed configuration.

As shown in FIG. 19, when the cap 1601 is assembled, the flaps 1670 of primary insert 121 are not aligned with the flaps 1670 of adjacent secondary insert 122. (Likewise, but not shown, the flaps of secondary insert 122 are not aligned with the flaps of adjacent tertiary insert 123.)

To use cap 1601, the opening 1606 is placed over the free end 111 of the rebar 110, and the cap 1601 is pushed down into place, either by hand, or by impact of a tool such as a hammer. The free end 111 pushes on the tip of each primary flap of primary insert 1621, causing each flap to rotate about its respective hinge. The free end 111 then pushes on the tip of each secondary flap of secondary insert 1622, causing each flap to rotate about its respective hinge. The free end 111 then pushes on the tip of each tertiary flap of tertiary insert 1623, causing each flap to rotate about its respective hinge. When the free end 111 meets end 1603, its movement into the cavity 1605 is stopped.

The tip of each of the nine flaps of this sixth preferred embodiment is resting on the side of rebar 110. No significant deformation of the flaps has occurred, because each tip has reached this position by rotation of the flap about its hinge. Because the flaps of adjacent inserts are offset, rebar 110 is effectively centred in cavity 1605, so that approximately equal pressure is placed on the flaps of each insert 1620.

The flaps engage with the rebar 110 further down than the free end 111. This is advantageous when the free end 111 of the rebar 110 has been deformed, for example by being hammered into place.

The cap of the present invention can be used without modification for different sizes and shapes of rebar, including standard 10 mm, 12 mm, 16 mm, 22 mm or 35 mm diameter rods. This is because the diameter of the space between the tips of the flaps is automatically adjusted by rotation of each flap about its hinge as the cap is pressed over the end of the rebar. A wider rebar will push the flaps to a smaller angle $\alpha$, but still be locked into the cap.

Unlike the first preferred embodiment, the sixth preferred embodiment is not suitable for use with a waratah post.

Optionally, holes (not shown) may be included in at least one casing wall, so that a securing device (such as a cable tie or padlock) can be inserted through the hole and a corresponding hole in the rebar, to add extra security against removal of the cap 1601 from the rebar 110.

The embodiments shown and described in detail herein are by way of example only. The present invention is intended to include such modifications and variations thereto as may be obvious to one skilled in the art.

Seventh Preferred Embodiment

Figure 21:
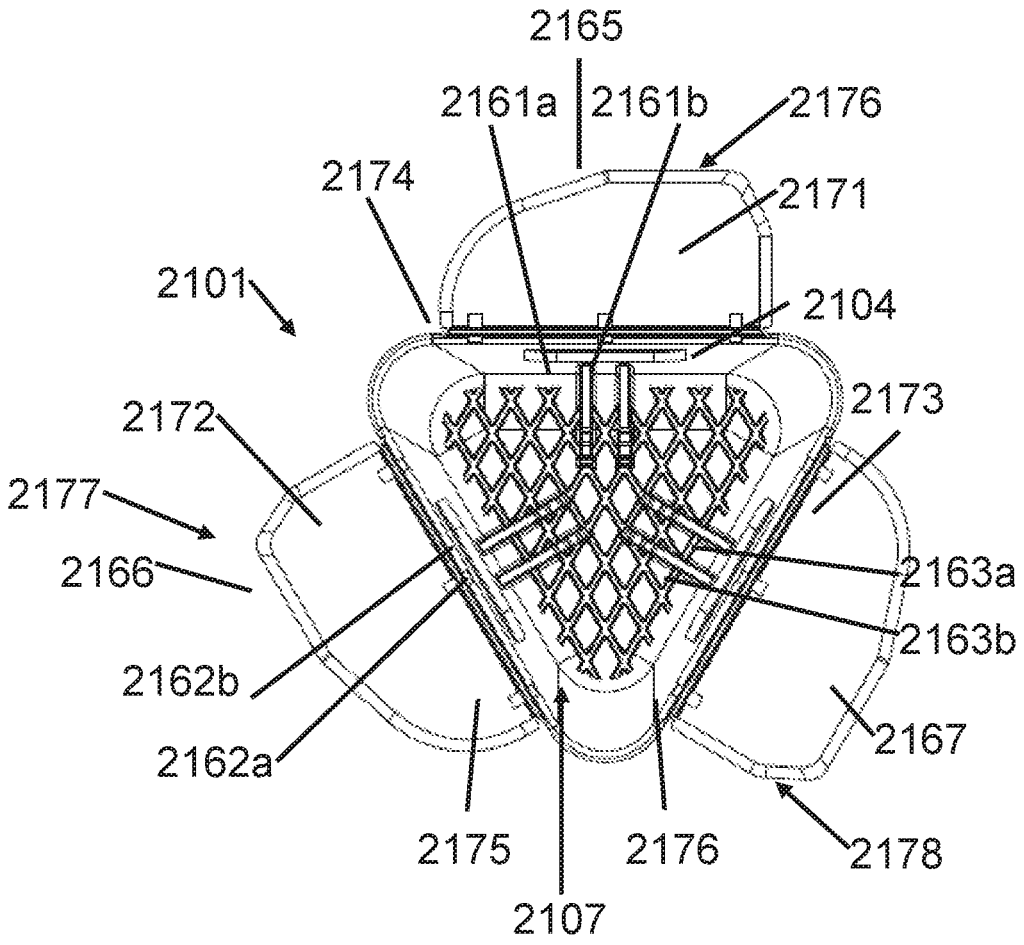
FIG. 21 is a bottom view of a seventh preferred embodiment of a rebar cap according to the present invention, in an open configuration.

A seventh preferred embodiment shown in FIG. 21 replicates many of the features of the second preferred embodiment. Features not specifically described as being different may be as described with reference to the second preferred embodiment and shown in detail in any of FIGS. 8 to 10, or with reference to the first preferred embodiment and shown in detail in any of FIGS. 1 to 7, and corresponding reference numerals are used.

FIG. 21 shows a cap 2101 in an open configuration. Cap 2101 includes a body 102 including an end 103 and at least one wall 2104. The at least one wall 2104 forms a substantially frusto-tetrahedral hollow (which may be about 70 mm long), closed at the narrow end by end 103 to form a cavity 105 with an opening 106 at the distal end of the body 102 from end 103. In this seventh preferred embodiment, there are three walls:—first wall 141, second wall 142 and third wall 143. The three walls are of equal width (preferably about 65 mm adjacent opening 106), and integrally formed, with the first wall 141 connecting to second wall 142 at a third vertex 153, second wall 142 connecting to third wall 143 at a first vertex 151, and third wall 143 connecting to first wall 141 at a second vertex 152. Preferably the three vertices are rounded, as shown in FIG. 2. The rounded triangular structure of body 102 is preferred because it can be easily manufactured to provide the necessary strength to withstand the impact of someone falling on it, with minimal structural weak points.

Body 102 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

The end 103 preferably includes reinforcing 2107 to increase its strength. The exact characteristics of the end 103 may be varied, as will be apparent to one skilled in the art, to comply with regulatory requirements in different jurisdictions.

In the cavity 105, near end 103, is at least one fin. In this seventh preferred embodiment, there are six fins, consisting of three pairs of fins. Primary first fin 2161*a* and secondary first fin 2161*b* extend from near the centre of first wall 141 towards first vertex 151, stopping at or before the central axis of body 102, and are contiguous with end 103. Each of primary first fin 2161*a* and secondary first fin 2161*b* tapers in steps towards an end point partway along first wall 141 towards opening 106, so that it does not protrude so far into cavity 105 away from end 103. Primary first fin 2161*a* and secondary first fin 2161*b* do not extend the entire length of the body 102. Primary second fin 2162*a* and secondary second fin 2162*b* extend from near the centre of second wall 142 towards second vertex 152, stopping at or before the central axis of body 102, and are contiguous with end 103.

Each of primary second fin 2162*a* and secondary second fin 2162*b* tapers in steps towards and end point partway along second wall 142 towards opening 106, so that it does not protrude so far into cavity 105 away from end 103. Primary second fin 2162*a* and secondary second fin 2162*b* do not extend the entire length of the body 102. Primary third fin 2163*a* and secondary third fin 2163*b* extend from the centre of third wall 143 towards third vertex 153, stopping at or before the central axis of body 102, and are contiguous with end 103. Each of primary third fin 2163*a* and secondary third fin 2163*b* tapers in steps towards an end point partway along third wall 143 towards opening 106, so that it does not protrude so far into cavity 105 away from end 103. Primary third fin 2163*a* and secondary third fin 2163*b* do not extend the entire length of the body 102.

Near the opening 106, the wall 104 includes at least one flap. In this seventh preferred embodiment, there are three flaps. First flap 2171 extends from first wall 141 adjacent the opening 106, and is connected to first wall 141 via a first hinge 181. At least one first lug 2174 may be provided on first flap 2171 and/or first wall 141 adjacent first hinge 181, to limit the rotation of first flap 2171. The shape of first flap 2171 is asymmetric, extending to a first tip 2176 which is offset from the centre line of first wall 141, and providing a first engagement edge 2165, which may be tapered.

Second flap 2172 extends from second wall 142 adjacent the opening 106, and is connected to second wall 142 via a second hinge 182. At least one second lug 2175 may be provided on second flap 2172 and/or second wall 142 adjacent second hinge 182, to limit the rotation of second flap 2172. The shape of second flap 2172 is asymmetric, extending to a second tip 2177 which is offset from the centre line of second wall 142, and providing a second engagement edge 2166, which may be tapered.

Third flap 2173 extends from third wall 143 adjacent the opening 106, and is connected to third wall 143 via a third hinge 183. At least one third lug 2176 may be provided on third flap 2173 and/or third wall 143 adjacent third hinge 183, to limit the rotation of third flap 2173. The shape of third flap 2173 is asymmetric, extending to a third tip 2178 which is offset from the centre line of third wall 143, and providing a third engagement edge 2167, which may be tapered.

In preparation for use, each flap is rotated about its respective pivot to a position in which it extends partially across the opening 106, or into the cavity 105. Adjacent flaps overlap each other, so that first tip 2176 lies under third engagement edge 2167, second tip 2177 lies under first engagement edge 2165, and third tip 2178 lies under second engagement edge 2166. This overlapping holds the flaps in position across the opening 106, so the cap is ready for use.

When cap 2101 is pushed over the free end of a rebar, the free end pushes on the engagement edge of each flap, causing each flap to rotate about its respective hinge. When the free end meets a step on the tapered fins, its movement into the cavity 105 is stopped. By including six fins, as in this seventh preferred embodiment, the free end of the rebar is effectively centred in the cavity 105.

In use, the engagement edge of each flap is resting on the side of rebar. No significant deformation of the flaps has occurred, because each engagement edge has reached this position by rotation of the flap about its hinge. If the cap 2101 is moved in a direction including an upwards component, the side wall of rebar pulls each engagement edge by friction, causing each flap to rotate about its hinge, increasing the pressure of the engagement edges on the side of the rebar, engaging it even more securely with the cap 2101.

Figure 22:
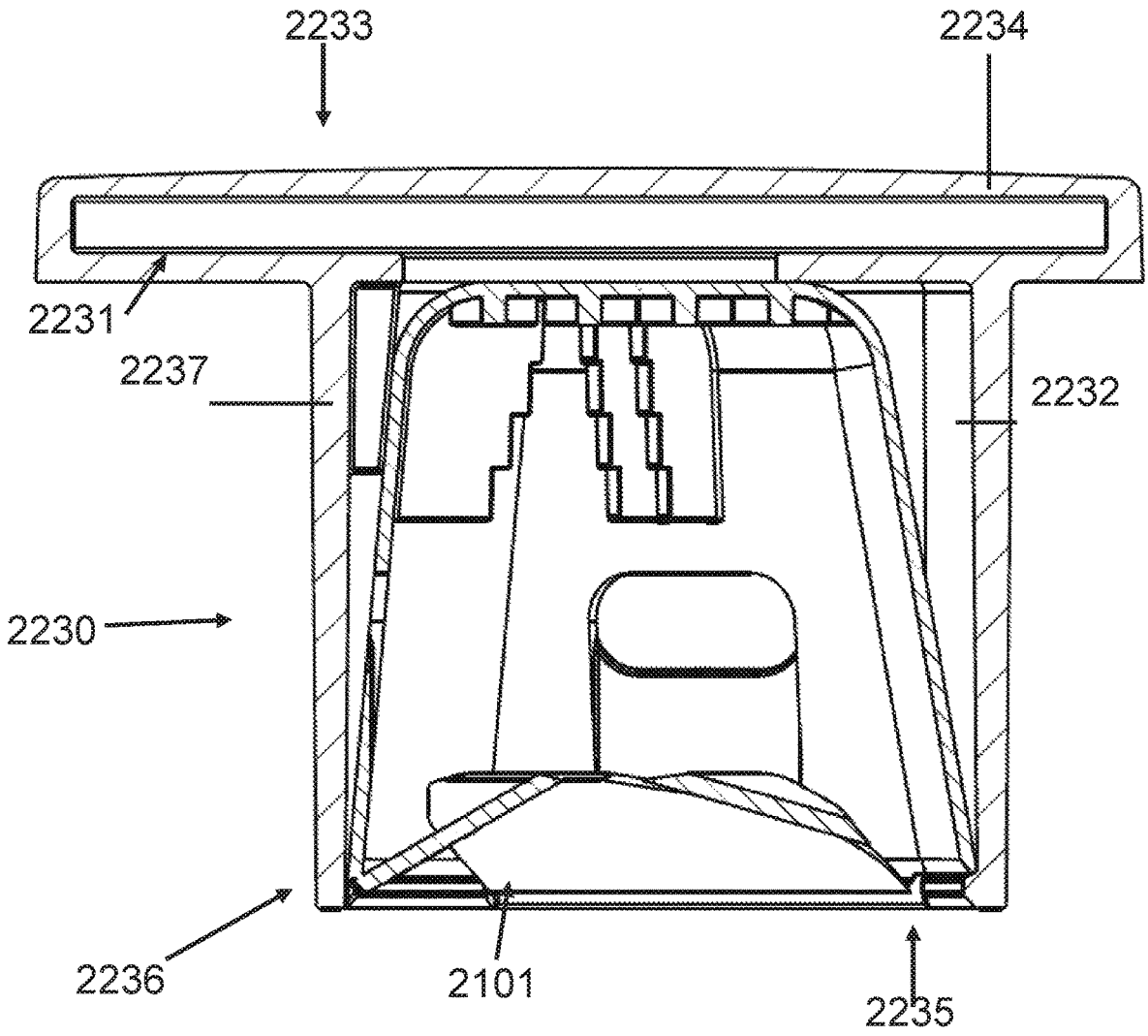
FIG. 22 is a cross-section of the combination of the rebar cap of FIG. 21, in a closed configuration, with an overcap, according to the present invention.

FIG. 22 shows the combination of a cap 2101 according to the seventh preferred embodiment with an overcap 2230. Overcap 2230 includes an overcap end 2231 and at least one overcap wall 2232. The at least one overcap wall 2232 forms an elongated hollow prism (which may be about 70 mm long), closed at one end by overcap end 2232 to form a cavity with an opening 2236 at the distal end of the overcap 2230 from overcap end 2232. In this preferred embodiment, the cavity is approximately an equilateral triangular prism, with rounded corners, dimensioned slightly larger than the size of cap 2101 at its opening 106. Adjacent opening 2236, at each rounded vertex of overcap wall 2232, is an engagement clip 2235. Inside the cavity, adjacent overcap end 2232, are one or more tapered engagement struts 2237. In a preferred embodiment, there are six struts, two on each side wall of overcap wall 2232.

Overcap 2230 is preferably manufactured from a UV-resistant plastics material, using known techniques such as plastic injection moulding, extrusion or printing. Alternatively, it could be manufactured from a corrosion resistant metal or other strong material suitable for use on an outdoor building site.

The overcap end 2231 extends beyond the circumference of overcap wall 2232, to provide a top plate surface 2233. This may be circular, having a diameter of at least 4 inches (10.16 cm) to comply with U.S. regulations. Alternatively, the top plate surface may be a different shape, such as square or hexagonal.

The overcap end 2231 also includes at least one reinforcing section 2234 to increase its strength, in this embodiment, in the form of a metal disk. The exact characteristics of the overcap end 2231 may be varied, as will be apparent to one skilled in the art, to comply with regulatory requirements in different jurisdictions. For example, compliance with the U.S. and European standard for withstanding a load of 250 pounds (~113 kg) dropped from 10 feet (~3 m) may be achieved by including metal disc 2234, as is known in the prior art.

In preparation for use, cap 2101 is inserted through opening 2236, until end 103 of cap 2101 is adjacent overcap end 2231. The or each tapered engagement strut 2237 engages with the outside of wall 2104 of cap 2101 to limit both rotation and lateral movement of cap 2101 inside the cavity of overcap 2230. Overcap 2230 is dimensioned so that each engagement clip 2235 sits under an edge of wall 104, to hold cap 2101 securely into overcap 2230.

The combination of overcap 2230 with a cap 2101 inserted into it can then be used as a single unit as a rebar cap, combining the rebar engagement mechanism of the cap 2101 with the additional size and reinforcing of the overcap 2230 to meet regulatory requirements.

The invention claimed is:

1. A safety cap for temporary installation on to a reinforcing bar, comprising:

a body including at least three walls defining a cavity having a longitudinal axis and an opening; and at least three flaps near the opening, wherein each of the at least three flaps includes a hinge edge connected to a substantially straight section of one of the at least three walls to create a hinged connection that is substantially orthogonal to the longitudinal axis of the cavity, so that the flap can rotate about the hinged connection relative to the wall to which it is connected, including to a ready position and an in use position, such that in the ready position each of the at least three flaps lies substantially across the opening, and adjacent flaps overlap each other such that part of each flap lies under part of an adjacent flap, so that all of the at least three flaps are held across the opening in the ready position.

2. The safety cap according to claim 1, wherein the three walls are of equal dimension.

3. The safety cap according to claim 2, further including at least one fin situated within the cavity and extending towards the longitudinal axis of the cavity.

4. The safety cap according to claim 3, wherein the amount the at least one fin extends towards the longitudinal axis of the cavity is tapered so as to reduce towards the opening.

5. The safety cap according to claim 3, wherein there are three fins.

6. The safety cap according to claim 3, wherein the body includes an end at an end of the cavity distal to the opening, and the at least one fin is integrally formed with the end.

7. The safety cap according to claim 1, integrally formed from a material selected from the list consisting of: UV resistant plastics, non-UV resistant plastics, and metal.

8. The safety cap according to claim 5, wherein the body includes an end at an end of the cavity distal to the opening, and the ef eaell at least one fin is integrally formed with the end.

9. The safety cap according to claim 2, integrally formed from a material selected from the list consisting of: UV resistant plastics, non-UV resistant plastics, and metal.

10. The safety cap according to claim 1, wherein the body includes an end plate at an end of the cavity distal to the opening, said end plate being adapted to withstand an impact.

11. The safety cap according to claim 10, wherein the end plate includes a metal plate.

12. The safety cap according to claim 5, wherein the at least one fin does not extend along the entire length of the cavity towards the opening.

13. The safety cap according to claim 2, wherein the shape of each of the at least three flaps is asymmetric, and includes a tip and an engagement edge, the engagement edge having a tip portion offset from a midpoint along the engagement edge such that in the ready position the tip of a first flap lies under the engagement face of a third flap, the tip of the second flap lies under the engagement edge of the first flap, and the tip of the third flap lies under the engagement edge of the second flap.

14. The safety cap as claimed in claim 2, wherein the body is a triangular prism shaped body.

15. The safety cap as claimed in claim 14, wherein the triangular prism shaped body includes three substantially flat walls that are each connected to adjacent walls by a rounded vertex.

16. The safety cap as claimed in claim 4, wherein the taper is in a series of steps.

17. The safety cap as claimed in claim 5, wherein the at least one fin extends from a center of one of the at least three walls and toward an opposite rounded vertex of the body.

18. The safety cap as claimed in claim 1, wherein each wall has a top edge and a bottom edge and each flap is hingedly connected to the top edge.

* * * * *